United States Patent [19]

Ogawa et al.

[11] Patent Number: 4,791,050

[45] Date of Patent: Dec. 13, 1988

[54] SILVER HALIDE COLOR PHOTOGRAPHIC MATERIAL

[75] Inventors: Akira Ogawa; Hiroshi Fukuzawa, both of Kanagawa, Japan

[73] Assignee: Fuji Photo Film Co., Ltd., Kanagawa, Japan

[21] Appl. No.: 46,750

[22] Filed: May 7, 1987

[30] Foreign Application Priority Data

May 7, 1986 [JP] Japan ..... 61-104246
Jun. 19, 1986 [JP] Japan ..... 61-143755

[51] Int. Cl.[4] ..... G03C 7/36

[52] U.S. Cl. ..... 430/506; 430/509; 430/546; 430/548; 430/549; 430/550; 430/552; 430/553; 430/554; 430/555; 430/557; 430/558

[58] Field of Search ..... 430/506, 557, 549, 550, 430/509, 505

[56] References Cited

U.S. PATENT DOCUMENTS

| | | | |
|---|---|---|---|
| 4,221,860 | 9/1980 | Hirose et al. | 430/549 |
| 4,370,410 | 1/1983 | Iijima et al. | 430/509 |
| 4,461,826 | 7/1984 | Yamashita et al. | 430/509 |
| 4,469,785 | 9/1984 | Tanaka et al. | 430/550 |
| 4,511,648 | 4/1985 | Yamashita et al. | 430/506 |
| 4,511,649 | 4/1985 | Ogawa et al. | 430/557 |
| 4,518,682 | 5/1985 | Kobayashi et al. | 430/557 |
| 4,543,323 | 9/1985 | Iijima et al. | 430/506 |
| 4,567,135 | 1/1986 | Arakawa et al. | 430/557 |

*Primary Examiner*—Won H. Louie
*Assistant Examiner*—Mark R. Buscher
*Attorney, Agent, or Firm*—Sughrue, Mion, Zinn, Macpeak, and Seas

[57] ABSTRACT

A silver halide color photographic material is described, which comprises a support having provided therein at least a blue-sensitive emulsion layer, a green-sensitive emulsion layer and a red-sensitive emulsion layer, with the blue-sensitive emulsion layer comprising at least two layers differing in sensitivity, one of which is the highest sensitive emulsion layer containing at least one yellow-dye-forming coupler represented by the general formula (I), and the other of which is the lowest sensitive emulsion layer containing at least one yellow-dye-forming coupler represented by the general formula (II), whereby a yellow dye image having high maximum density and excellent in sharpness, graininess and light fastness can be produced:

(I)

(II)

13 Claims, No Drawings

SILVER HALIDE COLOR PHOTOGRAPHIC MATERIAL

FIELD OF THE INVENTION

The present invention relates to a silver halide color photographic material and, more particularly, to a silver halide color photographic material which comprises a blue-sensitive emulsion layer having graininess and sharpness enhanced by improving on usage of yellow-dye-forming couplers. Further, it is concerned with a silver halide color photographic material which can provide a yellow dye image excellent in fastness to light.

BACKGROUND OF THE INVENTION

In the subtractive color process, a color image, as is well known, can be formed by the oxidative coupling reaction that takes place in a silver halide emulsion between a yellow-dye, a cyan-dye- or a magenta-dye-forming coupler and the oxidation product of a color developing agent of an aromatic primary amine type, which is produced in reduction of silver halide grains exposed to light by the color developing agent.

In the above process, compounds having an active methylene group can be generally employed as a yellow coupler for forming a yellow dye, compounds of pyrazolone, pyrazolobenzimidazole, indazolone or like types can be generally employed as a magenta coupler for forming a magenta dye-, and compounds having a phenolic or naphtholic OH group can be generally employed as a cyan coupler for forming a cyan dye.

Each coupler is dissolved in a high boiling organic solvent insoluble substantially in water, and then added to a silver halide emulsion, which high boiling organic solvent may optionally be used together with auxiliary solvents. Also, each coupler may be added to an emulsion in the form of an alkaline aqueous solution. The former emulsion can produce a dye image superior to the latter emulsion in light fastness, moisture resistance, heat resistance, graininess and color sharpness.

Essential properties required of each coupler include not only forming a dye, but also having high solubility in a high boiling organic solvent or an alkaline aqueous solution, and having good dispersibility and stability in a silver halide photographic emulsion. In addition, it is to be desired that a coupler should produce such a dye as to be excellent in fastness to light, heat and moisture, spectral absorption characteristics, and transparency; provide such a developed image as to have distinctness and, what is of greater importance, high color density; have a high dye-forming speed; and so on.

In recent years, color photographic material makers have made it feasible to take photographs at night, and to take photographs of scenes which necessitate a high speed shutter, e.g., to take photographs of sporting scenes, etc., and, on the other hand, have contributed to making an improvement in portability of cameras through miniaturization of films. These have been achieved due to improvements in the art of heightening sensitivity, graininess, resolving power and sharpness. Because increasing the sensitivity of a silver halide photographic material, as has so far been known, necessitates an increase in size of silver halide grains, increasing the sensitivity also causes deterioration of graininess and lowering of the resolving power. On the other hand, miniaturization of films requires an increase in magnification rate upon printing, taking the case of negative films, which brings about deterioration of graininess and resolving power and lowering of sharpness as an inevitable consequence. In order to aim at further increasing sensitivities of films and further miniaturizing films in the future, it is necessary to newly take long strides in these arts.

Known skeleton structures of yellow couplers include those of a pivaloylacetanilide type, a benzoylacetanilide type, a malondiester type, a malondiamide type, a dibenzoylmethane type, a benzothiazolylacetamide type, a malonic ester. monoamide type, a benzothiazolyl acetate type, a benzoxazolyl acetamide type, a benzoxazolyl acetate type, a benzimidazolyl acetamide type, a benzimidazolyl acetate type, and so on. Of these skeleton structures, those of the benzoylacetanilide and the pivaloylacetanilide types are of greater advantage.

Specific examples of the foregoing yellow couplers are described in U.S. Pat. Nos. 2,875,057, 3,265,506, 3,408,194, 3,551,155, 3,582,322, 3,725,072, 4,356,258 and 3,891,445, West German Pat. No. 1,547,868, West German Patent Application (OLS) Nos. 2,219,917, 2,261,361 and 2,414,006, British Pat. No. 1,425,020, Japanese Patent Publication No. 10783/76, and Japanese Patent Application (OPI) Nos. 26133/72, 73147/73, 102636/76, 6341/75, 123342/75, 130442/75, 21827/76, 87650/75, 82424/77 and 115219/77 (the term "OPI" as used herein refers to a "published unexamined Japanese patent application"), and so on. However, a silver halide photosensitive material which possesses all of the foregoing various properties satisfactorily has not yet been developed.

Hitherto, attempts to enhance graininess and sharpness of a color photoraphic material by devising a usage of couplers have been known. For instance, an art of enhancing the graininess which involves using two couplers differing in coupling reaction rate in two emulsion layers having the same color sensitivity respectively, that is, using a 4-equivalent coupler having a higher coupling reaction rate in the high sensitive emulsion layer, while using a 4-equivalent coupler having a lower coupling reaction rate in the low sensitive emulsion layer, is disclosed in U.S. Pat. No. 3,726,681. However, those couplers provide low color density upon color development. In particular, they manifest markedly lowered color-forming property when the amount of a high boiling organic solvent used for dissolving them is reduced as a method for thinning the emulsion layer, because thinning the emulsion layer is favorable for enhancing sharpness. In addition, the yellow dye image produced from those couplers has a serious defect in that its light fastness is remarkably low.

SUMMARY OF THE INVENTION

A first object of the present invention is to provide a silver halide color photographic material which can produce a yellow dye image excellent in graininess and sharpness.

A second object of the present invention is to provide a silver halide color photographic material which can manifest sufficiently high color-forming property even when a high boiling organic solvent is used in a reduced amount, or not used at all.

A third object of the present invention is to provide a silver halide color photographic material which can produce a yellow dye image excellent in light fastness.

The above-described objects have been attained by forming dye images through imagewise exposure of a silver halide color photographic material and subsequent development with an aromatic primary amine developing agent, with the silver halide color photographic material comprising a support having provided thereon at least a blue-sensitive emulsion layer, a green-sensitive emulsion layer and a red-sensitive emulsion layer, the blue-sensitive emulsion layer comprising at least two layers differing in sensitivity, one of which is the highest sensitive emulsion layer containing at least one yellow- dye-forming coupler represented by the general formula (I), and the other of which is the lowest sensitive emulsion layer containing at least one yellow-dye-forming coupler represented by the general formula (II):

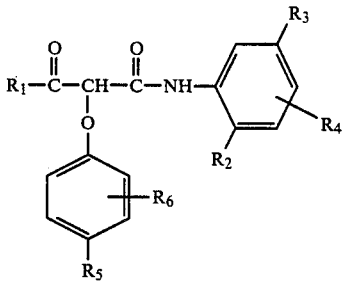

(I)

wherein $R_1$ represents a tertiary alkyl group; $R_2$ represents a halogen atom, an alkoxy group, or a hydrogen atom; $R_3$ represents an alkoxycarbonyl group, an aryloxycarbonyl group, an alkylsulfonamido group, an arylsulfonamido group, or an acylamino group; $R_4$ represents a hydrogen atom, a halogen atom, an alkoxy group, an alkyl group, or an acylamino group; $R_5$ represents an arylsulfonyl group, an alkylsulfonyl group, an alkoxycarbonyl group, an aryloxycarbonyl group, a cyano group, an acyl group, an acylamino group, an alkylsulfamoyl group, an arylsulfamoyl group, an alkylsulfonamido group, an arylsulfonamido group, an alkoxysulfonyl group, an aryloxysulfonyl group, an alkylcarbamoyl group, an arylcarbamoyl group, a carboxyl group, or a nitro group; and $R_6$ represents a hydrogen atom, a halogen atom, an alkyl group, an alkoxy group, a hydroxy group, an acylamino group, an alkylsulfonamido group, an arylsulfonamido group, a carboxyl group, or an alkoxycarbonyl group;

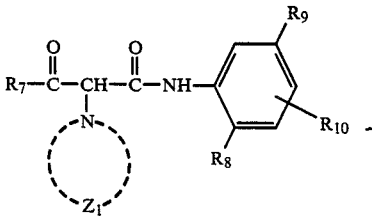

(II)

wherein $R_7$ represents a tertiary alkyl group; $R_8$ represents a halogen atom, or an alkoxy group; $R_9$ represents an alkoxycarbonyl group, an aryloxycarbonyl group, an alkylsulfonamido group, an arylsulfonamido group, or an acylamino group; $R_{10}$ represents a hydrogen atom, a halogen atom, an alkoxy group, an alkyl group, or an acylamino group; and Z1 represents non-metallic atoms necessary to form a 5- or 6-membered ring together with the nitrogen atom bonded to an active site.

DETAILED DESCRIPTION OF THE INVENTION

In the general formula (I), a tertiary alkyl group represented by $R_1$ includes unsubstituted (e.g., t-butyl, etc.) and substituted ones. Substituent groups which can be introduced into the foregoing alkyl group include halogen atoms (e.g., fluorine, chlorine, bromine, etc.), alkoxy groups (e.g., methoxy, ethoxy, etc.), aryloxy groups (e.g., phenoxy, 4-chlorophenoxy, etc.), arylthio groups (e.g., phenylthio, etc.), alkylsulfonyl groups (e.g., methanesulfonyl, etc.), arylsulfonyl groups e.g., benzenesulfonyl, etc.), acylamino groups (e.g., acetylamino, etc.), amino groups (e.g., diethylamino, etc.), a cyano group, and so on.

$R_2$ represents a halogen atom (e.g., chlorine, bromine, etc.), an alkoxy group (e.g., methoxy, ethoxy, etc.), or a hydrogen atom.

$R_3$ represents an unsubstituted alkoxycarbonyl group (e.g., n-decyloxycarbonyl, n-dodecyloxycarbonyl, n-tetradecyloxycarbonyl, 3,7-dimethyloctyloxycarbonyl, etc.), and a substituted alkoxycarbonyl group. Substituent groups which can be introduced into the above-described alkoxycarbonyl groups include alkoxy groups (e.g., ethoxy, n-dodecyloxy, n-octyloxy, 2-n-octyloxyethoxy, etc.), alkoxycarbonyl groups (e.g., n-decyloxycarbonyl, n-dodecyloxycarbonyl, etc.), and so on. The aryloxycarbonyl group represented by $R_3$ includes unsubstituted aryloxycarbonyl groups (e.g., phenoxycarbonyl, naphthoxycarbonyl, etc.), and substituted aryloxycarbonyl groups. Substituent groups which can be introduced into the above-described aryloxycarbonyl groups include alkyl groups (e.g., t-amyl, n-nonyl, t-octyl, etc.), alkoxy groups (e.g., n-octyloxy, n-decyloxy, etc.), halogen atoms (e.g., chlorine, etc.), acylamino groups (e.g., acetamido, n-dodecanamido, etc.), sulfonamido groups (e.g., n-hexadecanesulfonamido, etc.), alkoxycabonyl groups e.g., n-decyloxycarbonyl, etc.), carbamoyl groups (e.g., n-decylcarbamoyl, etc.), sulfamoyl groups (e.g., n-hexadecylsulfamoyl, etc.), and so on. The alkylsulfonamido group represented by $R_3$ includes unsubstituted ones (e.g., n-dodecanesulfonamido, n-hexadecanesulfonamido, etc.), and substituted ones. Substituent groups which can be introduced into the above-described alkylsulfonamido groups include alkoxy groups (e.g., n-dodecyloxy, 2-n-octyloxyethoxy, etc.). The arylsulfonamido group represented by $R_3$ includes unsubstituted ones (e.g., benzenesulfonamido, etc.), and substituted ones. Substituent groups which can be introduced into the above-described arylsulfonamido groups include those which can be introduced into the foregoing aryloxycarbonyl groups, and so on. The acylamino group represented by $R_3$ includes unsubstituted ones (e.g., n-dodecanamido, etc.), and substituted ones. Substituent groups which can be introduced into the above-described acylamino groups include aryloxy groups (e.g., 2,4-di-t-amylphenoxy, n-dodecanamidophenoxy, etc.), alkoxy groups (e.g., n-decyloxy, etc.), and so on.

$R_4$ represents a hydrogen atom, a halogen atom (e.g., chlorine, bromine, etc.), an alkoxy group (e.g., methoxy, ethoxy, etc.), an alkyl group (e.g., methyl, ethyl, etc.), or an acylamino group (e.g., acetamido, etc.). Substituent groups which may be introduced into the above-described alkoxy, alkyl and acylamino groups include those which can be introduced into the foregoing alkyl groups represented by $R_1$.

The arylsulfonyl group represented by $R_5$ includes unsubstituted ones (e.g., phenylsulfonyl, etc.), and substituted ones. Substituent groups which can be introduced into the above-described arylsulfonyl groups include a hydroxy group, a chlorine atom, alkyl groups (e.g., methyl, etc.), and alkoxy groups (e.g., methoxy, etc.). All alkyl moieties in the alkylsulfonyl group, the alkoxycarbonyl group, the acyl group, the acylamino group, the alkylsulfamoyl group, the alkylsulfonamido group, the alkoxysulfonyl group and the alkylcarbamoyl group, which groups are all represented by $R_5$, have no substituent. On the other hand, all aryl moieties in the aryloxycarbonyl group, the acylamino group, the arylsulfonamido group, the arylsulfamoyl group, the aryloxysulfonyl group and the arylcarbamoyl group, which groups are all represented by $R_5$, may be substituted with the substituent groups which can be introduced into the foregoing aryloxycarbonyl groups represented by $R_3$. $R_6$ represents a hydrogen atom, a halogen atom (e.g., chlorine, bromine, etc.), an alkyl group (e.g., methyl, etc.), an alkoxy group (e.g., methoxy, etc.), a hydroxy group, an acylamino group (e.g., acetamido, etc.), an alkylsulfonamido group (e.g., methanesulfonamido, etc.), an arylsulfonamido group (e.g., benzenesulfonamido, etc.), a carboxyl group, or an alkoxycarbonyl group (e.g., methoxycarbonyl, etc.). Substituent groups which may be introduced into the above-described alkyl, alkoxy, acylamino, alkylsulfonaido, arylsulfonamido and alkoxycarbonyl groups include those which can be introduced into the foregoing alkyl groups represented by $R_1$ In the general formula (II), the tertiary alkyl group represented by $R_7$ includes the same unsubstituted and substituted tertiary alkyl groups as represented by the foregoing $R_1$.

$R_8$ represents a halogen atom (e.g., chlorine, bromine, etc.), or an alkoxy group (e.g., methoxy, etc.).

The alkoxycarbonyl group, the aryloxycarbonyl group, the alkylsulfonamido group, the arylsulfonamido group and the acylamino group, respectively, which are represented by $R_9$, include the same unsubstituted and substituted ones as represented by the foregoing $R_3$ $R_{10}$ represents a hydrogen atom, a halogen atom (e.g., chlorine, bromine, etc.), an alkoxy group (e.g., methoxy, etc.), an alkyl group (e.g., methyl), or an acylamino group (e.g., acetamido, etc.). Substituent groups which may be introduced into the above-described alkyl, alkoxy and acylamino groups include those which can be introduced into the foregoing alkyl groups represented by $R_1$.

$Z_l$ represents non-metallic atoms necessary to form a 5- or 6-membered ring together with the nitrogen atom bonded to the active site. Specific examples of the 5- or 6-membered heterocyclic ring represented by

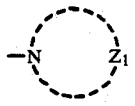

include those having the skeletons illustrated below.

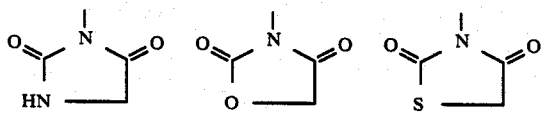

-continued

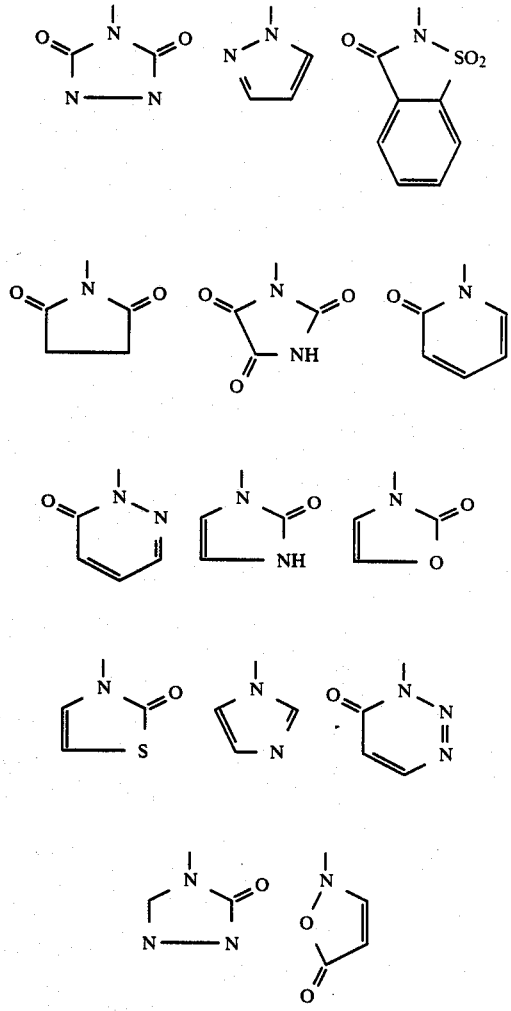

The hydrogen atoms attached to these heterocyclic ring skeletons may be replaced by a substituent group. Suitable examples of such a substituent group include an alkyl group (e.g., methyl, ethyl, ethoxyethyl, etc.), an aryl group (e.g., phenyl, 4-chlorophenyl, etc.), an aralkyl group (e.g., benzyl, etc.), an alkoxy group (e.g., methoxy, etoxy, etc.), a halogen atom (e.g., chlorine, etc.), an acylamino group (e.g., acetamido, etc.), a sulfonamido group (e.g., methanesulfonamido, etc.), a sulfamoyl group, a carbamoyl group, a carboxyl group, an alkoxycarbonyl group, a hydroxy group, a nitro group, a cyanq group, an alkenyl group (e.g., vinylmethyl, etc.), and so on.

In the general formula (I), couplers represented by the following general formula (III) or (IV) are preferred over others.

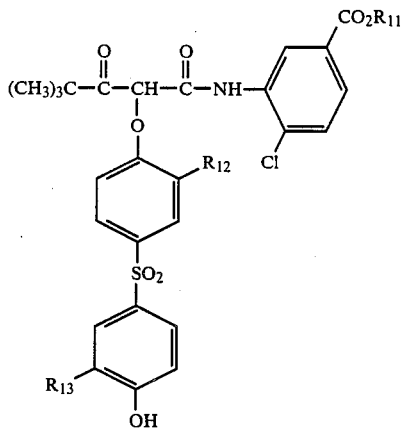

(III)

Herein, $R_{11}$ represents an unsubstituted or substituted alkyl group containing 8 to 20 carbon atoms. Suitable substituent groups for the alkyl group include alkoxy groups (preferably containing 2 to 12 carbon atoms) and alkoxycarbonyl groups (an alkyl moiety of which contains preferably 1 to 16 carbon atoms).

$R_{12}$ and $R_{13}$ each represents a hydrogen atom, a halogen atom (e.g., chlorine or bromine), an acylamino group (e.g., acetamido), or a sulfonamido group (e.g., methanesulfonamido, etc.). $R_{12}$ and $R_{13}$ may be the same or different. Substituent groups which may be introduced into the above-described acylamino and sulfonamido groups include those which can be introduced into the foregoing alkyl groups represented by $R_1$.

In the general formula (III), the most preferable couplers are those containing a straight or branched chain, unsubstituted alkyl group having 10 to 18 carbon atoms as $R_{11}$, and a hydrogen atom or a halogen atom (including chlorine and bromine) as $R_{12}$ and $R_{13}$.

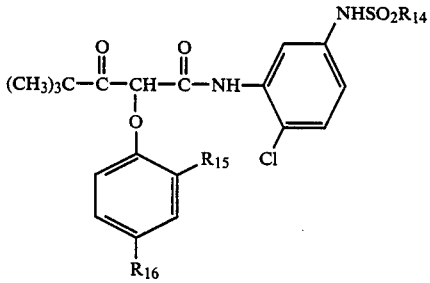

(IV)

Herein, $R_{14}$ represents an unsubstituted or substituted alkyl group containing 8 to 20 carbon atoms (an alkoxy group is preferred as a substituent group of the alkyl group), or a phenyl group having at least one alkoxy group (containing 4 to 16 carbon atoms) or having at least one alkyl group (containing 4 to 16 carbon atoms).

$R_{15}$ represents a hydrogen atom, a halogen atom (e.g., chlorine or bromine), an acylamino group (e.g., acetamido), or an alkylsulfonamido group (e.g., methanesulfonamido, etc.). Substituent groups which may be introduced into the above-described acylamino and alkylsulfonamido groups include those which can be introduced into the foregoing alkyl groups represented by $R_1$.

$R_{16}$ represents an alkoxycarbonyl group (an alkoxy moiety of which contains 2 to 16 carbon atoms), a sulfonamido group (e.g., methanesulfonamido, benzenesulfonamido, etc.), a cyano group, an acyl group, a sulfonyl group (e.g., methylsulfonyl, 4-hydroxyphenylsulfonyl, 3-chloro-4-hydroxyphenylsulfonyl, etc.), an acylamino group (e.g., acetamido, etc.), or a carbamoyl group (e.g., diethylcarbamoyl, etc.). Substituent groups which may be introduced into the above-described alkoxycarbonyl, sulfonamido, acyl, sulfonyl, acylamino and carbamoyl groups include those which can be introduced into the foregoing alkyl groups represented by $R_1$, and an alkyl group.

In the general formula (IV), the most preferable couplers are those having a straight or branched chain, unsubstituted alkyl group having 8 to 20 carbon atoms as $R_{14}$, a hydrogen atom or a halogen atom (including chlorine and bromine) as $R_{15}$, and an alkoxycarbonyl group (having a branched chain alkoxy moiety having 3 to 8 carbon atoms), a cyano group, an acyl group or a sulfonyl group as $R_{16}$.

In the general formula (II), more preferred couplers are represented by the following general formula (V):

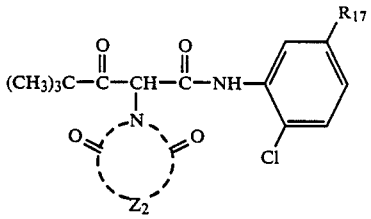

(V)

Herein, $R_{17}$ represents an unsubstituted or substituted alkoxycarbonyl group (containing 8 to 20 carbon atoms, and having as a substituent group an alkoxy group or an alkoxyalkyl group), or an unsubstituted alkylsulfonamido group (containing 8 to 20 carbon atoms).

$Z_2$ represents non-metallic atoms necessary to form a 5- or 6-membered ring.

In the general formula (V), the most preferable couplers are those containing a straight or branched chain, unsubstituted alkoxycarbonyl group having 10 to 18 carbon atoms or a straight or branched chain, unsubstituted alkylsulfonamido group having 8 to 20 carbon atoms as $R_{17}$, and a hydantoin nucleus as a ring completed by $Z_2$.

Representatives of the yellow couplers according to the present invention are illustrated below. However, the present invention should not be construed as being limited to the following compounds.

Couplers Represented by the General Formula (I)
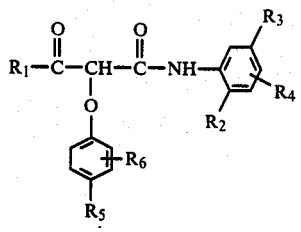
| No. | $R_1$ | $R_2$ | $R_3$ | $R_4$ | 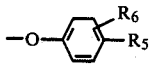 |
|---|---|---|---|---|---|
| I-1 | $(CH_3)_3C-$ | Cl | $-COC_{10}H_{21}(n)$ | H | 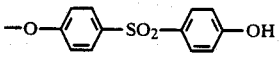 |
| I-2 | " | " | $-COC_{12}H_{25}(n)$ | " | " |
| I-3 | " | " | $-COC_{14}H_{29}(n)$ | " | " |
| I-4 | " | " | $-COC_{16}H_{33}(n)$ | " | " |
| I-5 | " | " | $-COC_9H_{19}(n)$ | " | " |
| I-6 | " | " | 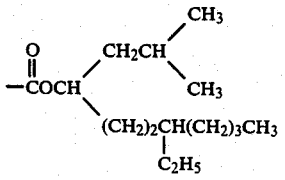 | " | " |
| I-7 | " | " | 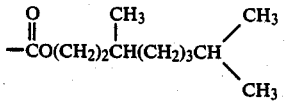 | " | " |
| I-8 | " | " | 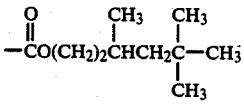 | " | " |
| I-9 | " | " | $-COC_{12}H_{25}(n)$ | " | 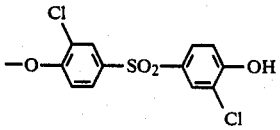 |
| I-10 | " | " | 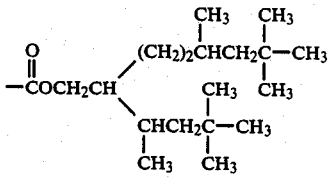 | " | 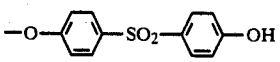 |
| I-11 | " | $-OCH_3$ | $-COC_{10}H_{21}(n)$ | " | 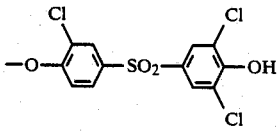 |

-continued
Couplers Represented by the General Formula (I)
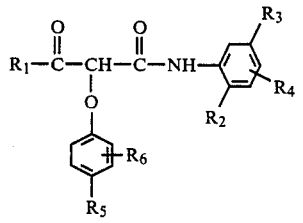
| No. | $R_1$ | $R_2$ | $R_3$ | $R_4$ | 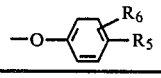 |
|---|---|---|---|---|---|
| I-12 | 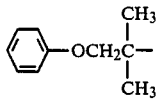 | Cl | " | " | 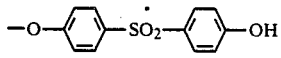 |
| I-13 | 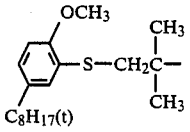 | " | $-COC_8H_{17}(n)$ | " | " |
| I-14 | $(CH_3)_3C-$ | " | $-NHSO_2C_{12}H_{25}(n)$ | " | 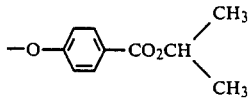 |
| I-15 | " | " | $-NHSO_2C_{16}H_{33}(n)$ | " | 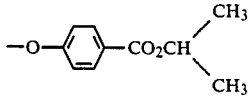 |
| I-16 | " | " | " | " | 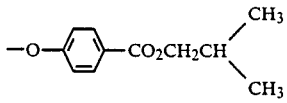 |
| I-17 | " | " | $-NHSO_2C_{12}H_{25}(n)$ | " | 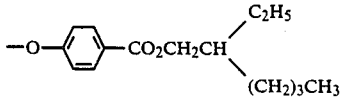 |
| I-18 | " | " | " | " | 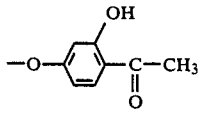 |
| I-19 | " | " | " | " | 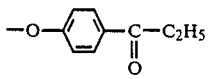 |
| I-20 | " | " | " | " | 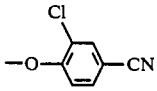 |
| I-21 | " | " | " | Cl | 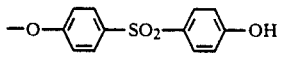 |
| I-22 | " | " | " | H | 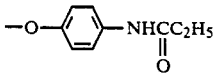 |

-continued
Couplers Represented by the General Formula (I)
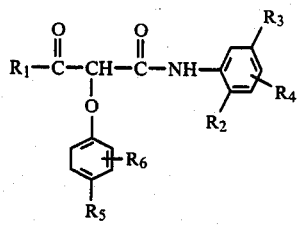
| No. | $R_1$ | $R_2$ | $R_3$ | $R_4$ | 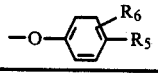 |
|---|---|---|---|---|---|
| I-23 | " | " | 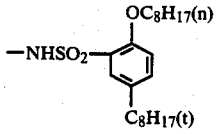 | " | 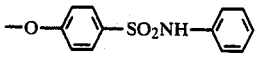 |
| I-24 | 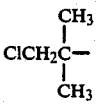 | " | 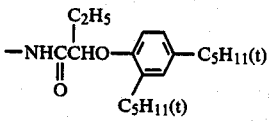 | " | 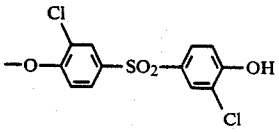 |
| I-25 | 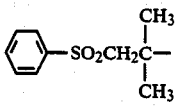 | " | " | " | 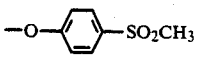 |
Couplers Represented by the General Formula (II)
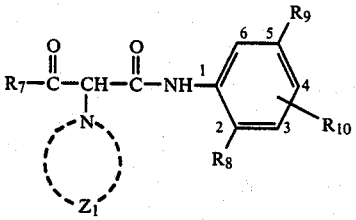
| No. | $R_7$ | $R_8$ | $R_9$ | $R_{10}$ | 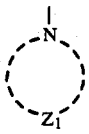 |
|---|---|---|---|---|---|
| II-1 | $(CH_3)_3C-$ | Cl | $-CO_2C_{12}H_{25}(n)$ | H | 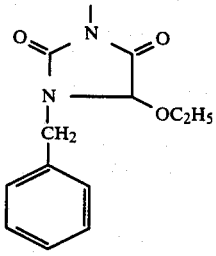 |
| II-2 | " | " | $-CO_2C_{10}H_{21}(n)$ | " | " |
| II-3 | " | " | $-CO_2C_{14}H_{29}(n)$ | " | " |
| II-4 | " | " | $-CO_2C_{16}H_{33}(n)$ | " | " |
| II-5 | " | " | $-CO_2C_9H_{19}(n)$ | " | " |
| II-6 | " | " | $-CO_2CH(CH_3)CO_2C_{10}H_{21}(n)$ | " | " |

-continued
Couplers Represented by the General Formula (II)
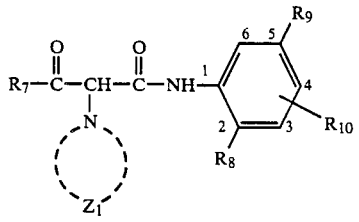
| No. | $R_7$ | $R_8$ | $R_9$ | $R_{10}$ | 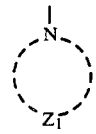 |
|---|---|---|---|---|---|
| II-7 | " | " | $-CO_2(CH_2)_2CH(CH_2)_3CH(CH_3)_2$ | " | 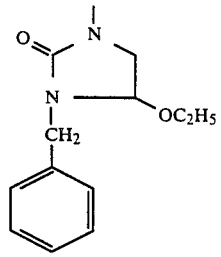 |
| II-8 | " | " | $-CO_2(CH_2)_2CHCH_2C(CH_3)_3$ | " | " |
| II-9 | " | " | $-CO_2CH_2CH(CH_2)_2CHCH_2C(CH_3)_3$ / $CHCH_2CCH_3$ ($CH_3$, $CH_3$) | " | " |
| II-10 | " | " | $-CO_2C_{12}H_{25}(n)$ | " | 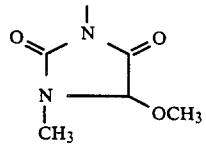 |
| II-11 | " | " | $-CO_2C_{12}H_{25}(n)$ | " | 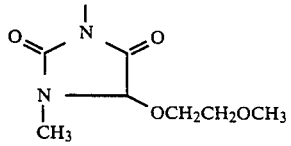 |
| II-12 | " | " | 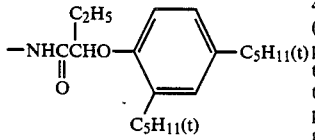 | 4-Cl (at 4-position of the phenyl group) | 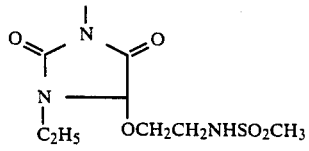 |

-continued
Couplers Represented by the General Formula (II)
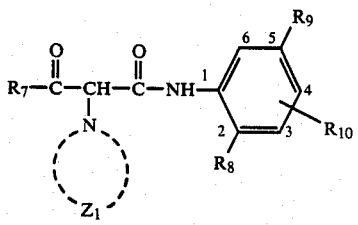
| No. | $R_7$ | $R_8$ | $R_9$ | $R_{10}$ | 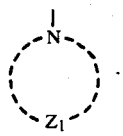 |
|---|---|---|---|---|---|
| II-13 | " | " | $-NHSO_2C_{16}H_{33}(n)$ | H | 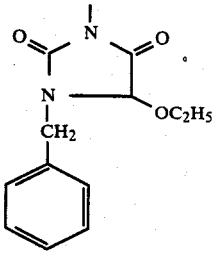 |
| II-14 | " | " | $-NHSO_2C_{16}H_{33}(n)$ | " | 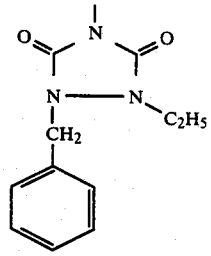 |
| II-15 | " | " | $-NHSO_2C_{12}H_{25}(n)$ | 4-Cl | 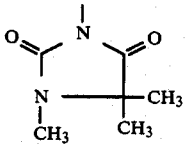 |
| II-16 | " | " | $-CO_2C_{12}H_{25}(n)$ | " | 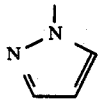 |
| II-17 | " | " | " | " | 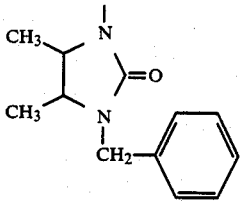 |
| II-18 | " | " | $-CO_2C_{12}H_{25}(n)$ | " | 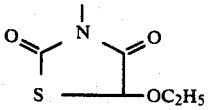 |

-continued
Couplers Represented by the General Formula (II)
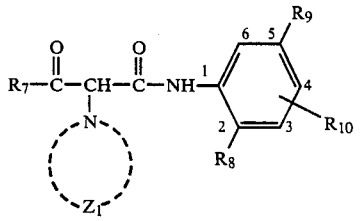
| No. | $R_7$ | $R_8$ | $R_9$ | $R_{10}$ | 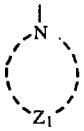 |
|---|---|---|---|---|---|
| II-19 | " | " | " | " | 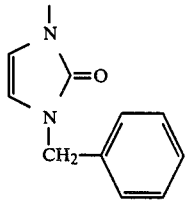 |
| II-20 | " | " | " | " | 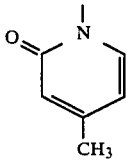 |
| II-21 | 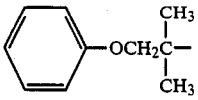 | $-OCH_3$ | 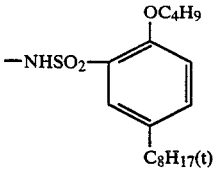 | H | 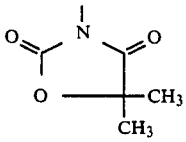 |
| II-22 | 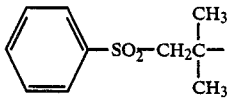 | " | 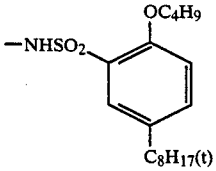 | 4-Cl | 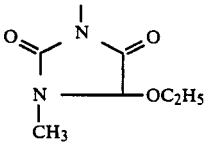 |
| II-23 | 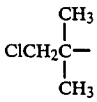 | " | $-CO_2C_{10}H_{21}(n)$ | " | 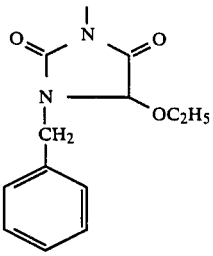 |
| II-24 | 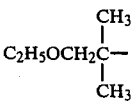 | " | " | " | " |

-continued

Couplers Represented by the General Formula (II)

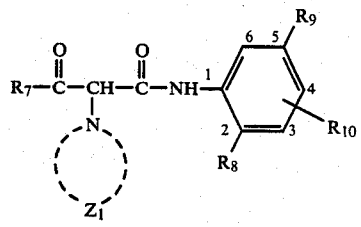

| No. | $R_7$ | $R_8$ | $R_9$ | $R_{10}$ | 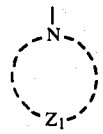 |
|---|---|---|---|---|---|
| II-25 | 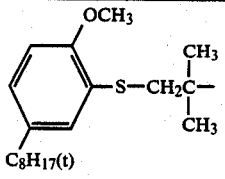 | " | " | " | " |
| II-26 | 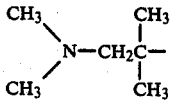 | " | $-CO_2C_{10}H_{21}(n)$ | " | 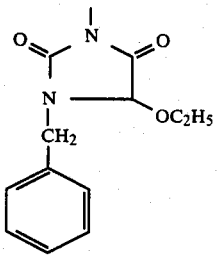 |
| II-27 | 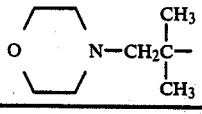 | " | " | " | " |

The yellow-dye-forming couplers to be employed in the present invention, which are represented by the general formula (I) or (II), can be easily synthesized with reference to the following literature.

The couplers represented by the general formula (I) can be synthesized with reference to Japanese Patent Application (OPI) No. 174839/84, U.S. Pat. Nos. 3,408,194, 4,401,752, 3,894,875, 3,933,501, 3,447,928 and 4,022,620 and so on, while the couplers represented by the general formula (II) can be synthesized with reference to Japanese Patent Publication No. 10739/83, U.S. Pat. Nos. 4,401,752 and 4,326,024, Research Disclosure, RD 18053 (April, 1979), British Pat. No. 1,425,020, West German Patent Application (OLS) Nos. 2,219,917, 2,261,361, 2,329,587, 2,433,812 and 4,289,847, Japanese Patent Application (OPI) No. 42046/83, and so on.

When the blue-sensitive emulsion layer comprises three or more layers in the present invention, the layers having intermediate sensitivities may contain either of the yellow-dye-forming couplers represented by the general formula (I) or (II).

In dispersing the yellow-dye-forming couplers of the present invention using an oil-in-water dispersion method, high boiling organic solvents represented by the following general formula (VI) or (VII) are preferably used alone, as a mixture of two or more thereof, or as a mixture with an auxiliary solvent (e.g., ethyl acetate, etc.). A ratio of the high boiling organic solvent to the coupler is 0.5 or less, preferably 0.2 or less, and more preferably 0.05 or less, by weight. Namely, the dispersion is preferably carried out using an auxiliary solvent alone.

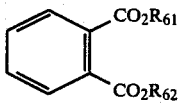

(VI)

wherein $R_{61}$ and $R_{62}$ may be the same or different, and each represents an alkyl group, a cycloalkyl group, an alkenyl group or an aryl group, provided that the substituent groups represented by $R_{61}$ and $R_{62}$ each contains 4 to 30 carbon atoms;

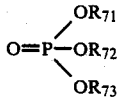

(VII)

wherein $R_{71}$, $R_{72}$ and $R_{73}$ may be the same or different, and each represents an alkyl group, a cycloalkyl group, an alkenyl group, or an aryl group, provided that the total number of carbon atoms contained in the substituent groups represented by $R_{71}$, $R_{72}$ or $R_{73}$ is 12 to 60.

The photographic emulsions to be employed in the present invention may be spectrally sensitized using methine dyes or other dyes. Suitable spectral sensitizing dyes which can be used include cyanine dyes, merocyanine dyes, complex cyanine dyes, complex merocyanine dyes, holopolar cyanine dyes, hemicyanine dyes, styryl dyes, and hemioxonol dyes. Especially useful dyes are cyanine dyes, merocyanine dyes and complex merocyanine dyes. Any nuclei usually present in cyanine dyes can be the basic heterocyclic nuclei of these dyes. More specifically, basic heterocyclic nuclei include pyrroline, oxazoline, thiazoline, pyrrole, oxazole, thiazole, selenazole, imidazole, tetrazole, pyridine and like nuclei; nuclei formed by fusing together one of the above-described nuclei and an alicyclic hydrocarbon ring; and nuclei formed by fusing together one of the above-described nuclei and an aromatic hydrocarbon ring. Specific examples of these fused nuclei include indolenine, benzindolenine, indole, benzoxazole, naphthoxazole, benzothiazole, naphthothiazole, benzoselenazole, benzimidazole, quinoline and like nuclei. Each of these nuclei may be substituted on a carbon atom also.

The merocyanine and complex merocyanine dyes can contain 5- or 6-membered heterocyclic nuclei such as pyrazoline-5-one, thiohydantoin, 2-thioxazolidine-2,4-dione, thiazolidine-2,4-dione, rhodanine, thiobarbituric acid and like nuclei, as ketomethylene structure-containing nuclei.

These sensitizing dyes may be employed individually or in combination. Combinations of sensitizing dyes are often used, particularly for the purpose of supersensitization.

Dyes or substances which can exhibit a supersensitizing effect in combination with a certain sensitizing dye, although the dyes themselves do not spectrally sensitize silver halide emulsions or the substances do not absorb light in the visible region, may be incorporated in the emulsion.

It is to be desired that at least one merocyanine or cyanine dye represented by the following general formula (VIII-1), (VIII-2), (IX) or (X) should be employed as a sensitizing dye to be incorporated in the blue-sensitive emulsion layer of the present invention. Also, two or more of such dyes may be used in combination.

(VIII-1)

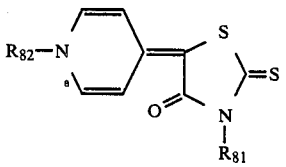

(VIII-2)

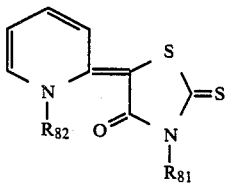

wherein $R_{81}$ represents an unsubstituted or substituted alkyl group, an unsubstituted or substituted aryl group, an aralkyl group, an alkenyl group, or an allyl group; and $R_{82}$ represents an unsubstituted or substituted alkyl group, an alkenyl group, or an allyl group.

(IX)

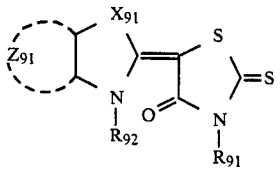

wherein $R_{91}$ has the same meaning as $R_{81}$ in the general formula (VIII-1); $R_{92}$ has the same meaning as $R_{82}$ in the general formula (VIII-1); $X_{91}$ represents an oxygen atom, or a sulfur atom; and $Z_{91}$ represents atoms necessary to complete a benzene ring or a naphthalene ring.

(X)

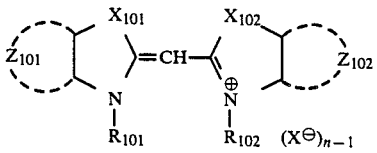

wherein and $X_{101}$ and $X_{102}$ each represents an oxygen atom, or a sulfur atom; $R_{101}$ and $R_{102}$ each has the same meaning as $R_{82}$ in the general formula (VIII-1); $Z_{101}$ and $Z_{102}$ each has the same meaning as $Z_{91}$ in the general formula (IX); $X^-$ represents an acid anion; and n represents 1 or 2.

Specific examples of the substituent group of the substituted alkyl group represented by $R_{81}$, $R_{82}$, $R_{91}$, $R_{92}$, $R_{101}$ or $R_{102}$ in the foregoing general formulae (VIII-1) to (X) include a sulfo group, a carboxyl group, an alkoxycarbonyl group, an alkoxy group, a hydroxy group, an acylamino group, a sulfonamido group, a sulfamoyl group, a carbamoyl group, and so on.

Specific examples of the substituent group of the substituted aryl group represented by $R_{81}$ or $R_{91}$ include a halogen atom, a cyano group, an amino group and an alkyl group in addition to the substituent groups set forth in respect of the above-described substituted alkyl group.

The benzene ring completed by $Z_{91}$, $Z_{101}$ or $Z_{102}$ may be substituted with a substituent group such as those set forth in respect of the foregoing substituted alkyl or aryl groups.

Specific examples of the sensitizing dyes resented by the general formulae (VIII-1) to (X), respectively, are set forth below.

| No. | $R_{81}$ | $R_{82}$ |
|---|---|---|
| | General Formula (VIII-1) | |
| VIII-1-1 | $-C_2H_5$ | $-(CH_2)_4SO_3Na$ |
| VIII-1-2 | $-CH_2-CH=CH_2$ | " |
| VIII-1-3 | $-CH_2CO_2H$ | " |
| VIII-1-4 | 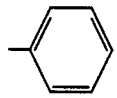 | " |
| VIII-1-5 | $-CH_2CH_2OH$ | " |
| VIII-1-6 | $-(CH_2)_2OCH_3$ | $+CH_2)_3SO_3Na$ |

-continued
| No. | $R_{81}$ | $R_{82}$ |
|---|---|---|
| VIII-1-7 | 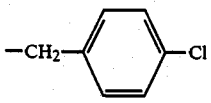 | " |
General Formula (VIII-2)
| | | |
|---|---|---|
| VIII-2-1 | $-C_2H_5$ | $-(CH_2)_4SO_3Na$ |
| VIII-2-2 | $-CH_2-CH=CH_2$ | " |
-continued
| No. | $R_{81}$ | $R_{82}$ |
|---|---|---|
| VIII-2-3 | 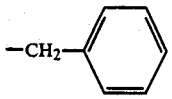 | " |
| VIII-2-4 | $-CH_2CH_2OH$ | $-(CH_2)_2NHSO_2CH_3$ |
| VIII-2-5 | $-CH_2CO_2H$ | $-(CH_2)_3SO_3K$ |
General formula (IX)
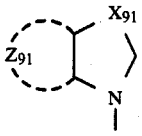
| No. | | $R_{92}$ | $R_{91}$ |
|---|---|---|---|
| IX-1 | 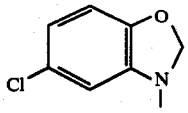 | $-(CH_2)_3SO_3Na$ | $-C_2H_5$ |
| IX-2 | 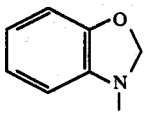 | $-(CH_2)_3SO_3HN(C_2H_5)_3$ | 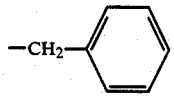 |
| IX-3 | " | " | $-CH_2CH_2OH$ |
| IX-4 | " | " | $-CH_2CO_2H$ |
| IX-5 | " | " | $-CH_2CH_2CH_3$ |
| IX-6 | 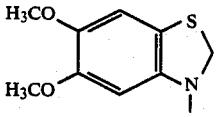 | $-(CH_2)_3SO_3Na$ | $-CH_2CH_2OH$ |
| IX-7 | 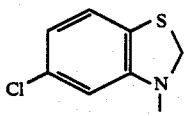 | " | 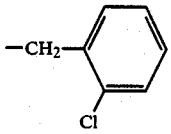 |
| IX-8 | 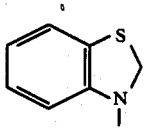 | $-(CH_2)_4SO_3Na$ | 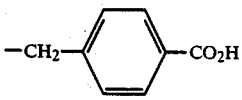 |
| IX-9 | " | $-(CH_2)_2SO_3Na$ | $-CH_2CO_2H$ |
| IX-10 | 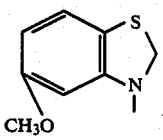 | $-(CH_2)_4SO_3HN(C_2H_5)_3$ | $-CH_2CH_2OH$ |
| IX-11 | 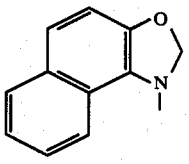 | $-(CH_2)_3SO_3Na$ | 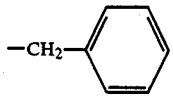 |

-continued
General formula (IX)
| No. | 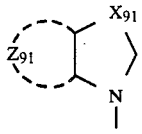 | $R_{92}$ | $R_{91}$ |
|---|---|---|---|
| IX-12 | 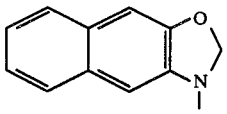 | " | " |
General Formula (X)
| No. | 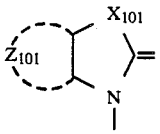 | $R_{101}$ | 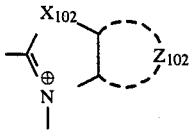 | $R_{102}$ | $X^{\ominus}$ |
|---|---|---|---|---|---|
| X-1 | 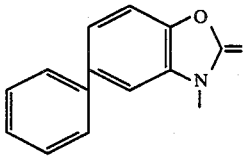 | $-(CH_2)_4SO_3^{\ominus}$ | 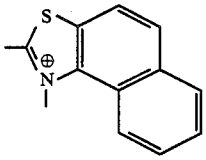 | $-(CH_2)_3SO_3HN(C_2H_5)_3$ | None |
| X-2 | " | " | 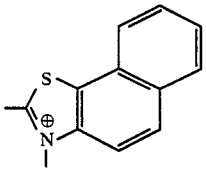 | " | " |
| X-3 | " | $-(CH_2)_3SO_3^{\ominus}$ | 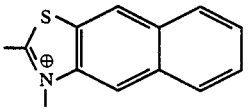 | " | " |
| X-4 | 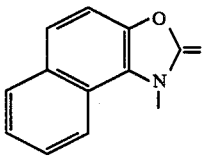 | " | 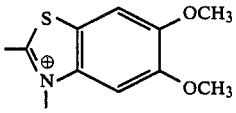 | " | " |
| X-5 | 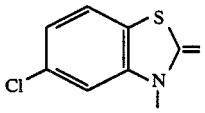 | $-(CH_2)_4SO_3^{\ominus}$ | 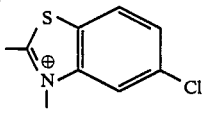 | $-(CH_2)_4SO_3HN(C_2H_5)_3$ | None |
| X-6 | 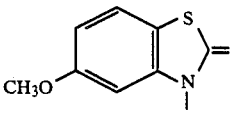 | $-(CH_3)_3SO_3^{\ominus}$ | 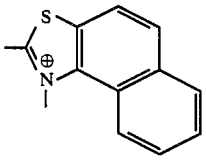 | $-(CH_2)_3SO_3HN(C_2H_5)_3$ | " |

-continued

| No. | General Formula (X) | $R_{101}$ | General Formula (X) | $R_{102}$ | $X^{\ominus}$ |
|---|---|---|---|---|---|
| X-7 | " | " | 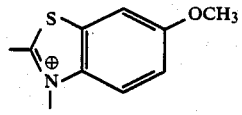 | $-(CH_2)_2SO_3Na$ | " |
| X-8 | " | $-C_2H_5$ | " | $-C_2H_5$ | 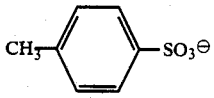 |
| X-9 | 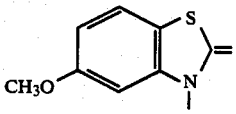 | $-CH_2CH_2OH$ | 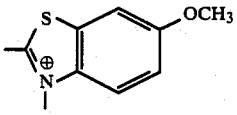 | $-C_2H_5$ | $Br^{\ominus}$ |
| X-10 | 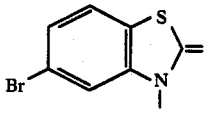 | $-(CH_2)_4SO_3^{\ominus}$ | " | $-(CH_2)_3SO_3NH(C_2H_5)_3$ | None |
| X-11 | 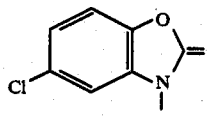 | " | 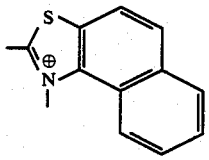 | $-(CH_2)_3SO_3HN(C_2H_5)_3$ | " |
| X-12 | 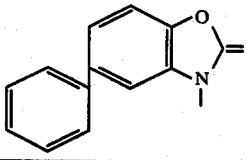 | " | 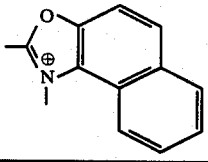 | $-(CH_2)_3SO_3HN(C_2H_5)_3$ | " |

Magenta couplers which can be employed in the present invention include those of the oil-protected indazolone or cyanoacetyl type, and preferably those of the pyrazoloazole type, such as 5-pyrazolones, pyrazolotriazoles and the like, and polymerized magenta couplers.

Of these magenta couplers, polymerized magenta couplers of 5-pyrazolone type, magenta couplers of pyrazoloazole type and polymerized magenta couplers of pyrazoloazole type are particularly preferred.

Specific examples of polymerized magenta couplers of 5-pyrazolone type are described in U.S. Pat. No. 4,409,320, Japanese Pat. Application (OPI) Nos. 23856/85 and 224352/83, U.S. Pat. Nos. 4,436,808, 4,474,870 and 4,444,870, Japanese Pat. Application (OPI) No. 94752/82, and so on.

Specific examples of magenta couplers of the pyrazolotriazole type include pyrazolobenzimidazoles described in U.S. Pat. No. 3,369,879, and, preferably, pyrazolo[5,1-c][1,2,4]triazoles described in U.S. Pat. No. 3,725,067, pyrazolotetrazoles described in *Research Disclosure,* No. 24220 (June, 1984), and pyrazolopyrazoles described in *Research Disclosure,* No. 24230 (June, 1984). From the viewpoints of smallness of yellow side-absorption and excellence of light fastness of the colored dyes, imidazo[1,2-b]pyrazoles described in European Pat. No. 119,741 are preferable, and pyrazolo[1,5-b][1,2,4]triazoles described in European Pat. No. 119,860 are particularly preferable.

Specific examples of polymerized magenta couplers of the pyrazoloazole type are described in Japanese Patent Application (OPI) Nos. 228252/84 and 35732/85, and so on.

Cyan couplers which can be employed in the present invention include those of the oil-protected naphthol and phenol types. As representatives of the naphthol type couplers, mention may be made of those described in U.S. Pat. No. 2,474,293, preferably 2-equivalent naphthol type couplers having oxygen atom-linked coupling-off groups, as described in U.S. Pat. Nos. 4,052,212, 4,146,396, 4,228,233 and 4,296,200. Specific examples of phenol type couplers are described in U.S. Pat. Nos. 2,369,929, 2,801,171, 2,772,162 and 2,895,826, and so on. Typical examples of cyan couplers which can be preferably employed in the present invention because of their excellent fastness to moisture and temperature include phenol type couplers having an alkyl group higher than an ethyl group at the meta-position of their phenol nucleus, which are described in U.S. Pat. No. 3,772,002; 2,5-diacylamino-substituted phenol type couplers described, e.g., in U.S. Pat. Nos. 2,772,162, 3,758,308, 4,126,396, 4,334,011 and 4,327,173, West German Patent Application (OLS) No. 3,329,729, Japanese Patent Application No. 42671/83 (corresponding to Japanese Patent Application (OPI) No. 166956/84), and so on; phenol type couplers having a phenylureido group at the 2-position and an acylamino group at the 5-position, which are described, e.g., in U.S. Pat. Nos. 3,446,622, 4,333,999, 4,451,559 and 4,427,767; and so on.

In particular, phenol type couplers having, at the 2-position, a fluorinated acylamido group and, at the 5-position, an unsubstituted acylamido group having 8 to 30 carbon atoms or a phenoxy group-substituted acylamido group having 6 to 28 carbon atoms are preferred.

A standard amount of a color coupler to be used ranges from 0.001 mol to 1 mol per mol of light-sensitive silver halide. Preferably, a yellow-dye-forming coupler is used in an amount of 0.01 to 0.5 mol, a magenta-dye-forming coupler is used in an amount of 0.003 to 0.3 mol, and a cyan-dye-forming coupler is used in an amount of 0.002 to 0.3 mol.

Standard coverages of color couplers in color paper are within the range of $4\times10^{-4}$ to $14\times10^{-4}$ mol/m$^2$ with respect to a yellow-dye-forming coupler, $2\times10^{-4}$ to $8\times10^{-4}$ mol/m$^2$ with respect to a magenta-dye-forming coupler, and $2\times10^{-4}$ to $9\times10^{-4}$ mol/m$^2$ with respect to cyan-dye-forming coupler.

The silver halide emulsion to be used in the present invention is prepared generally by mixing a solution of water-soluble silver salt (e.g., silver nitrate) with a solution of water-soluble halide (e.g., potassium bromide, sodium chloride, potassium iodide, or a mixture of two or more thereof) in the presence of a water-soluble macromolecular medium like gelatin. Representatives of the thus-prepared silver halides are silver chloride, silver bromide, and mixed halides such as silver chlorobromide, silver chloroiodobromide, silver iodobromide, etc. Silver halides which can be used preferably in the present invention are iodide-free silver halides, and silver chloroiodobromide, silver iodochloride or silver iodobromide, each of which contains iodide in a proportion of 3% or less.

The interior and the surface of the silver halide grains may be different, the silver halide grains may have such a multiphase structure as to have an epitaxial junction, or the silver halide grains may be uniform throughout. The silver halide grains of the above-described kinds may be present as a mixture. To take a concrete instance, an example of silver chlorobromide grains having different phases will be described. The grains may have, in the interior thereof, a core, or a single or multiple layer having a higher bromide content than the mean bromide content. Also, the grains may have, in the interior thereof, a core, or a single or multiple layer having a higher chloride content than the mean chloride content. Accordingly, the surface layer of the grains may be covered with either a layer having a higher bromide content than the mean bromide content or a layer having a higher chloride content than the mean chloride content.

The mean grain size of the silver halide grains (the term grain size as used herein refers to a grain diameter in the case of grains spherical or approximately spherical in shape, while it refers to the edge length in the case of cubic grains; in both cases, it is represented by the mean based on projected areas of the grains) ranges preferably from 0.1 micron to 2 microns, particularly preferably from 0.15 micron to 1 micron. The distribution of the grain size may be either narrow or broad. A so-called monodispersed silver halide emulsion, which has such a narrow grain size distribution as to be defined as a dispersion system in which 90%, particularly 95%, or more of the grains have their individual sizes within the range of the number or weight average grain size ±40%, can be employed in the present invention. In order to satisfy the gradation aimed at by the light-sensitive material, in the emulsion layers having substantially the same color sensitivity, two or more monodispersed silver halide emulsions differing in grain size can be coated in a single layer as a mixture, or they can be coated separately in a multilayer. Also, two or more polydispersed silver halide emulsions, or a combination of monodispersed and polydispersed emulsions may be coated as a mixture, or separately in a multilayer.

The silver halide grains to be employed in the present invention may have a regular crystal form, such as that of a cube, an octahedron, a dodecahedron or a tetradecahedron, or an irregular crystal form, such as that of a sphere or so on. Also, the grains may have a composite form of these crystal forms. Moreover, the grains may have a tabular form.

(A preferred proportion of the tabular grains, which have a thickness of less than 0.5 micron, a diameter of 0.6 micron or more and a mean aspect ratio of 5 or more, to the whole silver halide grains present in the emulsion layer containing such grains is at least 50% on the basis of the projected area of the whole silver halide grains. The term aspect ratio as used herein refers to a ratio of the grain diameter to the grain thickness. Herein, the diameter refers to the diameter of the circle having the same area as the projected area of the grain, and the thickness refers to the distance between two parallel planes constructing the tabular grains. The tabular silver halide grains may have any halide composition, that is, they may be silver bromide, silver iodide, silver iodobromide, silver chlorobromide, silver chloroiodobromide, or silver chloride. Of these halides, silver bromide, silver iodide and silver imdobromide are preferred over others. In particular, silver iodide or silver iodobromide having an iodide content of up to 30 mol % is desirable.)

Emulsions which contain silver halide grains having various kinds of crystal forms as a mixture may be employed. These various kinds of emulsions may be either those which form a latent image predominantly at the surface of the grains, or those which mainly form a latent image inside the grains.

These photographic emulsions for use in the present invention can be prepared using various methods as described, e.g., in P. Grafkides, *Chimie et Physique Photographique,* Paul Montel, Paris (1967), G. F. Duffin, *Photographic Emulsion Chemistry,* The Focal Press, London (1966), V. L. Zelikman et al., *Making and Coating Photographic Emulsion,* The Focal Press, London (1964) and so on. More specifically, any process, e.g., the acid process, the neutral process, the ammoniacal process and so on, can be employed.

Suitable methods for reacting a water-soluble silver salt with a water-soluble halide include, e.g., a single jet method, a double jet method or a combination thereof.

Also, a method in which silver halide grains are produced in the presence of excess silver ion (the so-called reverse mixing method) can be employed. Moreover, the so-called controlled double jet method, in which the pAg of the liquid phase in which silver halide grains are to be formed is maintained constant, may be employed. According to this method, silver halide emulsions having a regular crystal form and an almost uniform grain size can be obtained.

In a process of producing silver halide grains or allowing the produced silver halide grains to ripen phsyically, cadmium salts, zinc salts, lead salts, thallium salts, iridium salts or the complexes thereof, rhodium salts or the complexes thereof, iron salts or the complexes thereof and/or the like may be present.

Tabular silver halide grains can be prepared using properly combined methods well known in the art.

For instance, a tabular silver halide emulsion can be obtained in the following manner. Firstly seed crystals in which tabular grains are present in a proportion of 40% or more by weight are prepared under the condition that the pBr is kept at 1.3 or less, that is, under a relatively low pBr atmosphere and then the seed crystals are made to grow by simultaneous addition of silver and halide solutions under the condition that the pBr is maintained to a similar extent as described above.

In this grain growth process, it is desirable to add the silver solution and the halide solution under such a condition as not to cause further nucleation.

The size of tabular silver halide grains can be adjusted within a desired range by controlling the reaction temperature, selecting the kind and the quality of solvent to be used, controlling the addition rates of the silver salt and the halide to be used at the time of grain growth, and so on.

In producing the tabular silver halide grains of the present invention, a silver halide solvent can optionally be used, whereby a grain size, a grain shape (e.g., a diemater/thickness ratio, etc.), a grain size distribution, and a rate of grain growth can be controlled. It is preferable to use the solvent in a concentration ranging from $10^{-3}$ to 1.0 wt %, particularly from $10^{-2}$ to $10^{-1}$ wt %, of the reaction solution.

The grain size distribution becomes nearer to the perfect monodispersed distribution and the grain growth rate becomes higher, the more the amount of the solvent used is. However, the thickness of the grains tends to increase with amount of the solvent used.

In producing the tabular silver halide grains, a silver halide solvent is added for accelerating the grain growth. For this purpose, methods of increasing the addition rates, the addition amounts and the addition concentrations of a. silver salt solution (e.g., an aqueous solution of $AgNO_3$) and a halide solution (e.g., an aqueous solution of KBr) are preferably employed.

Details of these methods are described, e.g., in British Patent No. 1,335,925, U.S. Pat. Nos. 3,650,757, 3,672,900 and 4,242,445, Japanese Patent Application (OPI) Nos. 142329/80, 158124/80, 113927/83, 113928/83, 111934/83 and 111936/83, and so on.

After grain formation, the silver halide emulsions are, in general, physically ripened, desalted, chemically ripened, and then subjected to a coating step.

When the physical ripening step is carried out in the presence of a known silver halide solvent (e.g., ammonia, potassium thiocyanate, or thioethers and thione compounds as described in U.S. Pat. No. 3,271,157, Japanese Patent Application (OPI) Nos. 12360/76, 82408/78, 144319/78, 100717/79 and 155828/79, and so on), a monodispersed emulsion having a regular crystal form and a grain size distribution near to uniform can be obtained. In order to remove soluble silver salts from the emulsions before or after the physical ripening step, the noodle washing method, a sedimentation method (thereby causing flocculation in the emulsion), an ultrafiltration method, or so on is employed.

The silver halide emulsions to be employed in the present invention can be chemically sensitized using a sulfur or selenium sensitization method, a reduction sensitization method, a noble metal sensitization method, and so on individually or in combination thereof.

For the chemical sensitization, sulfur sensitization methods using active gelatin or compounds containing sulfur capable of reacting with silver ion (e.g., thiosulfates, thioureas, mercapto compounds, rhodanines, etc.), reduction sensitization methods using reducing materials (e.g., stannous salts, amines, hydrazine derivatives, formamidinesulfinic acid, silane compounds, etc.), and noble metal sensitization methods using noble metal compounds (e.g., gold complex salts, and complex salts of Group VIII metals such as Pt, Ir, Pd, Rh, Fe, etc.) can be employed individually or as a combination thereof.

Photographic emulsions which can be used in the present invention can contain a wide variety of compounds for purposes of preventing fog or stabilizing photographic functions during production, storage, or photographic processing. More specifically, azoles, e.g., benzothiazolium salts, benzimidazolium salts, imidazoles, benzimidazoles (preferably 5-nitrobenzimidazoles), nitroindazoles, nitrobenzimidazoles, benzotriazoles (preferably 5-methylbenzotriazoles), triazoles, etc.; mercapto compounds, e.g., mercaptothiazoles, mercaptobenzothiazoles, mercaptobenzimidazoles, mercaptobenzoxazoles, mercaptooxadiazoles, mercaptothiadiazoles, mercaptotriazoles, mercaptotetrazoles (particularly 1-phenyl-5-mercaptotetrazole and the like), mercaptopyrimidines, mercaptotriazines, and so on; thiocarbonyl compounds like oxazolinethione; azaindenes, e.g., triazaindenes, tetraazaindenes (particularly 4-hydroxy-6-methyl(1,3,3a,7-)tetraazaindenes), pentaazaindenes, and so on; and many compounds which have been known as antifoggants or stabilizers such as benzenethiosulfonic acid, benzenesulfinic acid, benzenesulfonic acid amide, purines like adenine, and so on can be incorporated into the photographic emulsions.

Furtherdetails of specific examples and usages of antifoggants or stabilizers are described, e.g., in U.S. Pat. Nos. 3,954,474 and 3,982,947, Japanese Patent Publication No. 28660/77, *Research Disclosure,* RD 17643, VI-A to VI-M (December, 1978), E. J. Birr, *Stabilization of Photographic Silver Halide Emulsions,* Focal Press (1974), and so on.

The photographic material produced in accordance with the present invention may contain, as a color fog preventing agent or a color stain preventing agent, hydroquinone derivatives, aminophenol derivatives, amines, gallic acid derivatives, catechol derivatives, ascorbic acid derivatives, colorless-compound-forming-couplers, sulfonamidophenol derivatives and so on.

The photographic material of the present invention can contain various kinds of discoloration inhibitors. Representatives of organic discoloration inhibitors are hydroquinones, 6-hydroxychromans, 5-hydroxycoumarans, spirochromans, p-alkoxyphenols, hindered phenols including bisphenols as main members, gallic acid derivatives, methylenedioxybenzenes, aminophenols, hindered amines, and ether or ester derivatives obtained by silylating or alkylating a phenolic hydroxyl group of the above-cited compounds each. In addition, metal complex salts represented by (bissalicylaldoximato)-nickel complexes and (bis-N,N-dialkyldithiocarbamato)nickel complexes can be employed as a discoloration inhibitor.

Specific examples of organic discoloration inhibitors are described in the patent specifications listed below.

Specific examples of the hydroquinones are described in U.S. Pat. Nos. 2,360,290, 2,418,613, 2,700,453, 2,701,197, 2,728,659, 2,732,300, 2,735,765, 3,982,944 and 4,430,425, British Pat. No. 1,363,921, U.S. Pat. Nos. 2,710,801 and 2,816,028, and so on; those of 6-hydroxychromans, 5-hydroxycoumarans and spirochromans are described, e.g., in U.S. Pat. Nos. 3,432,300, 3,573,050, 3,574,627, 3,698,909 and 3,764,337, Japanese Pat. Application (OPI) No. 152225/77, and so on; those of spiroindans are described, e.g., in U.S. Pat. No. 4,360,589; those of p-alkoxyphenols are described, e.g., in U.S. Pat. No. 2,735,765, British Pat. No. 2,066,975, Japanese Patent Application (OPI) No. 10539/84, Japanese Patent Publication No. 19764/82, and so on; those of hindered phenols are described, e.g., in U.S. Pat. No. 3,700,455, Japanese Patent Application (OPI) No. 72225/77, U.S. Pat. No. 4,228,235, Japanese Patent Publication No. 6623/77, and so on; those of gallic acid derivatives, methylenedioxybenzenes and aminophenols are described in U.S. Pat. Nos. 3,457,079 and 4,332,886 and Japanese Patent Publication No. 21144/81, respectively; those of hindered amines are described, e.g., in U.S. Pat. Nos. 3,336,135 and 4,268,593, British Pat. Nos. 1,326,889, 1,354,313 and 1,410,846, Japanese Patent Publication No. 1420/76, Japanese Patent Application (OPI) Nos. 114036/83, 53846/84 and 78344/84, and so on; those of ethers and esters of phenolic hydroxyl groups are described, e.g., in U.S. Pat. Nos. 4,155,765, 4,174,220, 4,254,216 and 4,264,720, Japanese Patent Application (OPI) Nos. 145530/79, 6321/80, 105147/83 and 10539/84, Japanese Patent Publication No. 37856/82, U.S. Pat. No. 4,279,990, Japanese Patent Publication No. 3263/78, and so on; and those of metal complexes are described, e.g., in U.S. Pat. Nos. 4,050,938 and 4,241,155, British Pat. No. 2,027,731 (A), and so on.

On the prevention of deterioration of yellow dye images due to heat, moisture and light, compounds having both hindered amine and hindered phenol moieties in a molecule described in U.S. Pat. No. 4,268,593 can produce a desirable effect. In order to prevent magenta dye images from suffering deterioration, particularly due to light, spiroindans described in Japanese Patent Application (OPI) No. 159644/81, and chromans substituted with a hydroquinone di- or monoether described in Japanese Patent Application (OPI) No. 89835/80 are employed to advantage. The purpose can be achieved by incorporating some of these compounds into a light-sensitive layer in the form of an emulsion in which their corresponding coupler is emulsified together therewith. A preferred proportion of the discoloration inhibitor to its corresponding coupler ranges generally from 5 to 100 wt %. In order to prevent cyan dye images from suffering from deterioration due to heat, and particularly light, it is effective to incorporate an ultraviolet absorbent into both layers adjacent to the cyan-color-forming layer.

The photographic material of the present invention can contain an ultraviolet absorbent in a hydrophilic colloidal layer thereof.

For example, aryl-substituted benzotriazoles described in U.S. Pat. Nos. 3,553,794 and 4,236,013, Japanese Patent Publication No. 6540/76, European Pat. No. 57,160, and so on, butadienes described in U.S. Pat. Nos. 4,450,229 and 4,195,999, cinnamic acid esters described in U.S. Pat. Nos. 3,705,805 and 3,707,375, benzophenones described in U.S. Pat. No. 3,215,530 and British Pat. No. 1,321,355, and macromolecular compounds having an ultraviolet absorbing residue, as described in U.S. Pat. Nos. 3,761,272 and 4,431,726, can be employed. Also, ultraviolet absorbing brightening agents described in U.S. Pat. Nos. 3,499,762 and 3,700,455 may be employed. Typical examples of ultraviolet absorbents are described, e.g., in *Research Disclosure,* RD 24239 (June, 1984) and so on.

The photographic material of the present invention may further contain water-soluble dyes in a hydrophilic colloid layer thereof as a filter dye, or for various purposes, e.g., prevention of irradiation, antihalation, and so on. Suitable examples of such dyes include oxonol dyes, hemioxonol dyes, styryl dyes, merocyanine dyes, anthraquinone dyes and azo dyes. In addition to these dyes, cyanine dyes, azomethine dyes, triarylmethane dyes and phthalocyanine dyes are also used to advantage. Also, oil-soluble dyes emulsified according to an oil-in-water dispersion method can be added to a hydrophilic colloid layer.

The photographic material of the present invention may contain a brightening agent of stilbene type, triazine type, oxazole type, coumarin type or the like in a photographic emulsion layer or some other hydrophilic colloid layer thereof. A brightening agent to be used may be a water-soluble one, or a water-insoluble brightening agent may be used in the form of dispersion.

Gelatins are used to advantage as a binder or protective colloid to be contained in emulsion layers and interlayers of the photographic material of the present invention. Also, hydrophilic colloids other than gelatin can be used. Suitable examples of hydrophilic colloids which can be used include proteins such as gelatin derivatives, graft copolymers prepared from gelatin and other high polymers, albumin, casein, etc.; sugar derivatives such as cellulose derivatives, e.g., hydroxyethyl cellulose, carboxymethyl cellulose, cellulose sulfate and the like, sodium alginate, starch derivatives, etc.; and various kinds of synthetic hydrophilic macromolecular substances such as homo- and copolymers, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

Specific examples of gelatins include not only generally used lime-processed gelatin, but also acidprocessed gelatin, enzyme-processed gelatin as described in *Bull. Soc. Sci. Phot. Japan,* No. 16, p. 30 (1966), hydrolysis products of gelatin and enzymatic degradation products of gelatin.

The photographic material of the present invention may contain an inorganic or organic hardener in a photographic layer or an arbitrary hydrophilic colloid layer constituting its backing layer.

The photographic material of the present invention may contain at least one kind of surface active agent for a wide variety of purposes, for instance, as a coating aid, for prevention of generation of static charges, for improvement in slippability, for emulsifying dispersion, for prevention of generation of adhesion, for improvements in photographic characteristics (e.g., acceleration of development, increase in contrast, and sensitization), and so on.

Besides containing additives as described above, the photographic material of the present invention may further contain various stabilizers, stain inhibitors, developing agents or precursors thereof, development accelerators or precursors thereof, lubricants, mordants, matting agents, antistatic agents, plasticizers, or other additives useful for a photographic light-sensitive material. Typical examples of these additives are described in *Research Disclosure,* 17643 (December, 1978) and 18716 (January, 1979).

The present invention can also be applied to a multilayer multicolor photographic material having at least two light-sensitive emulsion layers each having different color sensitivity on a support. A multilayer color photographic material has, in general at least one red-sensitive emulsion layer, at least one green-sensitive emulsion layer and at least one blue-sensitive emulsion layer on a support. The order of these layers can be varied as desired. Preferred orders of these layers include the order of the red-sensitive emulsion layer, the green-sensitive emulsion layer and the blue-sensitive emulsion layer from the support side, and the order of the blue-sensitive emulsion layer, the red-sensitive emulsion layer, the green-sensitive emulsion layer from the support side. Each of the above-described emulsion layers may have two or more constituent layers differing in sensitivity, and a light-insensitive layer may be arranged between any two of the constituent layers having the same color sensitivity. Although it is general to incorporate a cyan-dye-forming coupler in a red-sensitive emulsion layer, a magenta-dye-forming coupler in a green-sensitive emulsion layer, and a yellow-dye-forming coupler in a blue-sensitive emulsion layer, combinations other than the above-described one can be employed, if needed.

In addition to the above-described silver halide emulsion layers, it is desired to provide proper auxiliary layers, such as a protective layer, an interlayer, a filter layer, an antihalation layer, a backing layer and so on, in the photographic material according to the present invention.

In the photographic light-sensitive material of the present invention, photographic emulsion layers and other layers are coated on a conventionally used flexible support, such as a plastic film, paper, cloth or the like, or a rigid support such as glass, ceramic, metal or so on. Useful materials as a flexible support include films made up of semisynthetic or synthetic high polymers, such as cellulose nitrate, cellulose acetate, cellulose acetate butyrate, polystyrene, polyvinyl chloride, polyethylene terephthalate, polycarbonate, and so on, paper coated or laminated with a baryta layer or an α-olefin polymer film (e.g., a polyethylene film, a polypropylene film, an ethylene/butene copolymer film, etc.), and the like. A support may be colored with dyes or pigments. Also, it may be blackened for the purpose of cutting out light. The surface of such a support as described above is, in general, coated with a subbing layer in order to increase adhesiveness to a photographic emulsion layer or so on. Before or after coating of a subbing layer, a support surface may be subjected to a glow discharge, a corona discharge, an ultraviolet irradiation, a flame or like treatment.

In coating photographic emulsion layers and other hydrophilic colloid layers, various known coating methods, for example, a dip coating method, a roller coating method, a curtain coating method, an extrusion coating method and so on, can be employed. Many layers may be coated simultaneously using a coating method as described in U.S. Pat. Nos. 2,681,294, 2,761,791, 3,526,528 and 3,508,894, and so on, if desired.

The present invention can be applied to various kinds of color photographic materials. The representatives of color photographic materials to which the present invention can be applied are color negative films for general use or motion picture use, color reversal films for slide use or television use, color paper, color positive films, and color reversal paper. The present invention can also be applied to a black-and-white photographic material which utilizes the process of mixing three color couplers, as described in *Research Disclosure,* No. 17123 (July, 1978).

A color developing solution to be used for development processing of the photographic material of the present invention is an alkaline aqueous solution containing preferably an aromatic primary amine type color developing agent as a main component. Preferred developing agents of such a type are p-phenylenediamine type compounds, although aminophenol type compounds are also useful. Representative compounds of p-phenylenediamine type developing agents are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochloride or p-toluenesulfonates of the above-cited anilines. These diamines are, in general, more stable in the form of salts than in the free state, so they are used preferably in the form of salts.

The color developing solution can generally contain pH buffering agents such as carbonates, borates or phosphates of alkali metals, and development inhibitors or antifoggants such as bromides, iodides, benzimidazoles, benzothiazoles or mercapto compounds. Further, preservatives such as hydroxylamines or sulfites, organic solvents such as triethanolamine or diethylene glycol, development accelerators such as benzyl alcohol, polyethylene glycol, quaternary ammonium salts or amines, dye-forming couplers, competing couplers, nucleating agents such as sodium boronhydride, auxiliary developing agents such as 1-phenyl-3-pyrazolidones, viscosity-imparting agents, various kinds of chelating agents represented by aminopolycarboxylic acids, aminopolyphosphonic acids, alkylphosphonic acids, phosphonocarboxylic acids and the like, antioxidants described in West German Patent Application (OLS) No. 2,622,950, and so on may be added to the color developing solution, if desired.

In the development processing of a color reversal photographic material, black-and-white development is usually carried out prior to color development. A black-and-white developing solution used therein can contain known black-and-white developing agents, such as dihydroxybenzenes like hydroquinone, 3-pyrazolidones like 1-phenyl-3-pyrazolidone, aminophenols like N-methyl-p-aminophenol, etc., individually or in combination thereof.

After color development, the photographic emulsion layers are subjected to a bleach-processing. The bleach processing may be carried out simultaneously with a fixing processing, or separately therefrom.

Suitable examples of bleaching agents which can be used include compounds of polyvalent metals such as Fe(III), Co(III), Cr(VI), Cu(II), etc., peroxy acids, quinones, nitroso compounds, and so on. The representatives of bleaching agents are ferricyanides; bichromates; organic complex salts of Fe(III) or Co(III), with examples of organic acids usable for forming such complex salts including aminopolycarboxylic acids, such as ethylenediaminetetraacetic acid, diethylenetriaminepentaacetic acid, nitrilotriacetic acid, 1,3-diamino-2-propanoltetraacetic acid, etc., citric acid, tartaric acid, malic acid and so on; persulfates; manganates; nitrosophenols; and so on. Of these bleaching agents, ethylenediaminetetraacetatoferrate(III) complex salts and persulfates are preferred from the standpoints of ensuring rapid processing and reducing environmental pollution. In particular, ethylenediaminetetraacetatoferrate(III) complex salts are used to advantage in both an independent bleaching bath and a combined bleaching and fixing bath.

To a bleaching bath or a bleach-fixing bath may be added various accelerators in combination, if needed. For example, in addition to bromine and iodine ions, thiourea type compounds as described in U.S. Pat. No. 3,706,561, Japanese Patent Publication Nos. 8506/70 and 26586/74, and Japanese Patent Application (OPI) Nos. 32735/78, 36233/78 and 37016/78; thiol type compounds as described in Japanese Patent Application (OPI) Nos. 124424/78, 95631/78, 57831/78, 32736/78, 65732/78 and 52534/79, U.S. Pat. No. 3,893,858, and so on; heterocyclic compounds as described in Japanese Patent Application (OPI) Nos. 59644/74, 140129/75, 28426/78, 141623/78, 14232/78 and 35727/79, and so on; thioether type compounds as described in Japanese Patent Application (OPI) Nos. 20832/77, 25064/80 and 26506/80, and so on; tertiary amines as described in Japanese Patent Application (OPI) No. 84440/73; thiocarbamoyls as described in Japanese Patent Application (OPI) No. 42349/74; and so on can be used alone or in combination of two or more thereof. Of these substances, bromine ion, iodine ion, thiol type compounds and disulfide type compounds function effectively as bleach accelerators. These bleach accelerators are especially effective in bleaching and fixing color photographic materials for picture-taking use.

Examples of usable fixing agents include thiosulfates, thiocyanates, thioether type compounds, thioureas, a large amount of iodide, and so on. In general, thiosulfates are used as a fixing agent. As the preservatives for a bleach-fixing bath or a fixing bath, sulfites, bisulfites and the adducts of carbonyl and bisulfites are preferably used.

After bleach-fixing processing or fixing processing, a washing processing is generally carried out. In the step of washing, addition of various known compounds may be carried out for purposes of preventing precipitation and saving washing water. In order to prevent the precipitation from occurring, a water softener such as an inorganic phosphoric acid, an aminopolycarboxylic acid, an organic phosphonic acid, or so on can be added. Also, a germicide and a bactericide for inhibiting various bacteria, waterweeds and molds from breaking out; a hardener represented by a magnesium salt or an aluminum salt; a surface active agent for lightening drying load and preventing drying mark from generating; and so on can be added, if needed. In addition, compounds as described in L. E. West, *Water-Quality Criteria, Photo. Sci. Eng.*, Vol. 6, pp. 344 to 359 (1965) may be added. In particular, addition of chelating agents and bactericides is effective.

The washing step is, in general, carried out using two or more tanks according to the countercurrent washing method for the purpose of saving water. On the other hand, a multistage countercurrent stabilization processing step as described in Japanese Patent Application (OPI) No. 8543/82 may be carried out in place of the washing step. In this step, it is required of the countercurrent bath to have 2 to 9 tanks. To the stabilizing bath are added various kinds of compounds in order to stabilize the images. As typical examples of such additives, mention may be made of various buffering agents for adjusting the pH to a proper value (ranging generally from 3 to 8), such as those obtained by combining properly acids and alkalis selected from among borates, metaborates, borax, phosphates, carbonates, potassium hydroxide, sodium hydroxide, aqueous ammonia, monocarboxylic acids, dicarboxylic acids, polycarboxylic acids and the like, and formaldehyde. The stabilizing bath may further contain a water softener (e.g., inorganic phosphoric acids, aminopolycarboxylic acids, organic phosphonic acids, aminopolyphosphonic acids, phosphocarboxylic acids, or so on), a germicide (e.g., benzisothiazolinone, isothiazolone, 4-thiazolinebenzimidazole, halogenophenols, or so on), a surface active agent, a brightening agent, a hardener and other various kinds of additives, if desired. Two or more kinds of compounds may be used for the same purpose or different purposes.

In addition, it is desired that various ammonium salts, such as ammonium chloride, ammonium nitrate, ammonium sulfate, ammonium phosphate, ammonium sulfite, ammonium thiosulfate and the like, should be added to the stabilizing bath in order to control the pH in the processed film.

A color developing agent may be incorporated into the silver halide color photographic material of the present invention for purposes of simplifying and quickening the photographic processing. Incorporation of the color developing agent is carried out to advantage by using it in the form of a precursor. Examples of precursors of color developing agents which can be used include indoaniline type compounds described in U.S. Pat. No. 3,342,597, Schiff base type compounds described in U.S. Pat. No. 3,342,599 and *Research Disclosure,* Nos. 14850 and 15159, aldol compounds described in *Research Disclosure,* No. 13924, metal salt complexes described in U.S. Pat. No. 3,719,492, urethane type compounds described in Japanese Patent Application (OPI) No. 135628/78, and precursors of various salt types which are described in Japanese Patent Application (OPI) Nos. 6235/81, 16133/81, 59232/81, 67842/81, 83734/81, 83735/81, 83736/81, 89735/81, 81837/81, 54430/81, 106241/81, 107236/81, 97531/82 and 83565/82, and so on.

Further, various 1-phenyl-3-pyrazolidones may optionally be incorporated in the silver halide color photographic material of the present invention for the purpose of accelerating the color development. Typical compounds thereof are described in Japanese Patent Application (OPI) Nos. 4339/81, 144547/82, 211147/82, 50532/83, 50536/83, 50533/83, 50534/83, 50535/83 and 115438/83, and so on.

Various processing solutions in the present invention are used at a temperature of 10° C. to 50° C. A standard temperature is within the range of 33° C. to 38° C. When carried out at a temperature higher than the standard temperature range, the processing can be accelerated to result in reduction of processing time, while improvement of image quality and enhancement of stability of processing solutions can be achieved by carrying out the processings at lower temperatures. In addition, a processing utilizing cobalt intensification or hydrogen peroxide intensification, as described in West German Patent 2,226,770 or U.S. Pat. No. 3,674,499, may be carried out for the purpose of saving silver.

Various processing baths may be equipped with a heater, a temperature sensor, a liquid level sensor, a circular pump, a filter, a floating lid, a squeezer, or so on.

The following examples will serve to illustrate the present invention in more detail, but they are not to be construed as limiting the present invention in any manner.

EXAMPLE 1

On a cellulose acetate film support were coated the layers having the compositions described below to prepare a photographic element.

First Layer

A yellow-dye-forming coupler and a high boiling organic solvent were mixed and ethyl acetate was added thereto and then the resulting mixture was heated to make a solution. The thus-obtained solution was emulsified and dispersed in a gelatin aqueous solution containing a surface active agent (sodium dodecylbenzenesulfonate) to prepare an emulsified dispersion of yellow-dye-forming coupler. The emulsified dispersion and a silver iodobromide emulsion (iodide content: 6 mol %, mean grain size: 0.8 micron) were mixed so that the ratio of the silver content to the coupler content in the resulting emulsion would be 2.5:1 by mol.

Second Layer

To a mixture of a yellow-dye-forming coupler and a high boiling organic solvent, ethyl acetate was added and heated for making a solution. An emulsified dispersion of the yellow-dye-forming coupler was prepared in the same manner as in the first layer. The emulsified dispersion and a silver iodobromide emulsion (iodide content: 6 mol %, mean grain size: 1.2 micron) were mixed so that the ratio of the silver content to the coupler content in the resulting emulsion would be 3.5:1 by mol, whereby a coating composition was prepared.

Third Layer

A gelatin aqueous solution was mixed with a hardener (1,3-vinylsulfonyl-2-propanol) and a surface active agent to prepare a coating composition.

The yellow-dye-forming couplers and high boiling organic solvents used together in the first layer and the second layer were so changed as to be set forth in Table 1 to prepare coated Samples 101 to 112. Each coverage of the yellow-dye-forming coupler was controlled to 1.70 mmol/m$^2$. The coated Sample 111 was obtained in accordance with such method that the coating composition was used in the form of a 5% aqueous solution as described in U.S. Pat. No. 3,726,681.

Each sample was exposed to blue light, and then subjected to photographic processing including the following steps at 38° C.

| | |
|---|---|
| Color Development | 3 min 15 sec |
| Bleaching | 6 min 30 sec |
| Washing | 2 min 10 sec |
| Fixation | 4 min 20 sec |
| Washing | 3 min 15 sec |
| Stabilization | 1 min 5 sec |

Processing solutions used in their respective steps had the following compositions.

| | |
|---|---|
| Color Developing Solution: | |
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N—Ethyl-N—β-hydroxyethylamino)-2-methylaniline Sulfate | 4.5 g |
| Water to make | 1.0 liter |
| pH adjusted to | 10.0 |
| Bleaching Solution: | |
| Ammonium Ethylenediaminetetraacetato-ferrate(III) | 100.0 g |
| Disodium Ethylenediaminetetraacetate | 10.0 g |
| Ammonium Bromide | 150.0 g |
| Ammonium Nitrate | 10.0 g |
| Water to make | 1.0 liter |
| pH adjusted to | 6.0 |
| Fixing Solution: | |
| Disodium Ethylenediaminetetraacetate | 1.0 g |
| Sodium Sulfite | 4.0 g |
| Aqueous Solution of Ammonium Thiosulfate (70%) | 175.0 ml |
| Sodium Bisulfite | 4.6 g |
| Water to make | 1.0 liter |
| pH adjusted to | 6.6 |
| Stabilizing Solution: | |
| Formalin (40%) | 2.0 ml |
| Polyoxyethylene-p-monononylphenyl Ether (mean polymerization degree: 10) | 0.3 g |
| Water to make | 1.0 liter |

Comparative Coupler A:

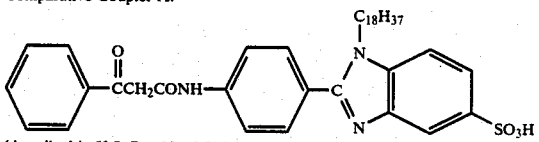

(described in U.S. Pat. No. 3,726,681)

Comparative Coupler B:

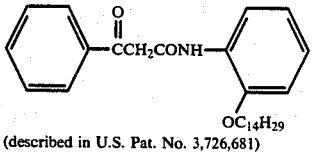

(described in U.S. Pat. No. 3,726,681)

TABLE 1

| | Second Layer | | First Layer | |
|---|---|---|---|---|
| Sample No. | Coupler | High Boiling Organic Solvent (ratio to coupler by weight) | Coupler | High Boiling Organic Solvent (ratio to coupler by weight) |
| 101 (Invention) | Coupler I-1 | Dibutyl Phthalate (0.1) | Coupler II-1 | Dibutyl Phthalate (0.1) |
| 102 (Invention) | Coupler I-1 | Not Used | Coupler II-1 | Not Used |

TABLE 1-continued

| Sample No. | Second Layer Coupler | Second Layer High Boiling Organic Solvent (ratio to coupler by weight) | First Layer Coupler | First Layer High Boiling Organic Solvent (ratio to coupler by weight) |
|---|---|---|---|---|
| 103 (Invention) | Coupler I-2 | Tricresyl Phosphate (0.1) | Coupler II-2 | Dibutyl Phthalate (0.1) |
| 104 (Invention) | Coupler I-2 | Not Used | Coupler II-2 | Not Used |
| 105 (Invention) | Coupler I-14 | Dibutyl Phthalate (0.1) | Coupler II-1 | Dibutyl Phthalate/Tricresyl Phosphate (1/1) (0.1) |
| 106 (Invention) | Coupler I-14 | Not Used | Coupler II-1 | Not Used |
| 107 (Comparison) | Coupler II-1 | Dibutyl Phthalate (0.1) | Coupler II-1 | Dibutyl Phthalate (0.1) |
| 108 (Comparison) | Coupler II-1 | Not Used | Coupler II-1 | Not Used |
| 109 (Comparison) | Coupler I-1 | Dibutyl Phthalate (0.1) | Coupler I-1 | Dibutyl Phthalate (0.1) |
| 110 (Comparison) | Coupler I-1 | Not Used | Coupler I-1 | Not Used |
| 111 (Comparison) | Coupler B | — | Coupler A | — |
| 112 (Comparison) | Coupler B | Dibutyl Phthalate (0.1) | Coupler B | Dibutyl Phthalate (0.1) |

In Table 2, fog values, relative sensitivities (shown with Sample 10 being taken as 100), $D_{max}$, and light fastness, which was measured under the following condition, are shown.

Light Fastness

Percentage (%) of color density after discoloration test under a fluorescent lamp (with an illuminance $1.6\times10^4$ lux over a period of 300 hours) to the intial color density of 1.0.

TABLE 2

| Sample No. | Fog | Relative Sensitivity | $D_{max}$ | Light Fastness (%) |
|---|---|---|---|---|
| 101 (Invention) | 0.03 | 100 | 2.60 | 89 |
| 102 (Invention) | 0.03 | 102 | 2.62 | 92 |
| 103 (Invention) | 0.03 | 101 | 2.61 | 88 |
| 104 (Invention) | 0.03 | 102 | 2.63 | 89 |
| 105 (Invention) | 0.02 | 106 | 2.62 | 91 |
| 106 (Invention) | 0.03 | 108 | 2.63 | 92 |
| 107 (Comparison) | 0.03 | 100 | 2.32 | 88 |
| 108 (Comparison) | 0.04 | 102 | 1.80 | 89 |
| 109 (Comparison) | 0.03 | 100 | 2.59 | 68 |
| 110 (Comparison) | 0.03 | 101 | 2.58 | 65 |
| 111 (Comparison) | 0.04 | 70 | 1.20 | 25 |
| 112 (Comparison) | 0.04 | 70 | 1.23 | 32 |

In accordance with the embodiments of the present invention, as can be seen from the results shown in Table 2, high color densities of developed images were achieved without being attended by increase in fog and dye images having excellent light fastness were obtained.

Comparative Samples 107 and 108 had a low $D_{max}$, and Comparative Samples 109 and 110 were inferior to the present samples in light fastness.

EXAMPLE 2

On a cellulose triacetate film support having a subbing layer were coated layers having the following compositions to prepare a multilayer color photographic material (which was designated Sample 201). A coating amount of an emulsion is indicated using an amount of silver coated.

| | |
|---|---|
| First Layer: Antihalation Layer | |
| Black colloidal silver | 0.25 g/m$^2$ |
| Ultraviolet Absorbent U-1 | 0.04 g/m$^2$ |
| Ultraviolet Absorbent U-2 | 0.1 g/m$^2$ |
| Ultraviolet Absorbent U-3 | 0.1 g/m$^2$ |
| High Boiling Organic Solvent O-1 | 0.1 ml/m$^2$ |
| Gelatin | 2.5 g/m$^2$ |
| Second Layer: Interlayer | |
| Compound H-1 | 0.05 g/m$^2$ |

-continued

| | |
|---|---|
| High Boiling Organic Solvent O-2 | 0.05 ml/m$^2$ |
| Gelatin | 0.6 g/m$^2$ |
| Third Layer: First Red-Sensitive Emulsion Layer | |
| Silver iodobromide emulsion sensitized spectrally with Sensitizing Dyes S-1 and S-2 (iodide content: 4 mol %, mean grain size: 0.3 micron) | 0.5 g/m$^2$ |
| Coupler C-1 | 0.25 g/m$^2$ |
| High Boiling Organic Solvent O-2 | 0.12 ml/m$^2$ |
| Gelatin | 1.1 g/m$^2$ |
| Fourth Layer: Second Red-Sensitive Emulsion Layer | |
| Silver iodobromide emulsion sensitized spectrally with Sensitizing Dyes S-1 and S-2 (iodide content: 2.5 mol %, mean grain size: 0.55 micron) | 0.8 g/m$^2$ |
| Coupler C-1 | 0.73 g/m$^2$ |
| High Boiling Organic Solvent O-2 | 0.37 ml/m$^2$ |
| Gelatin | 1.8 g/m$^2$ |
| Fifth Layer: Interlayer | |
| Compound H-1 | 0.1 g/m$^2$ |
| High Boiling Organic Solvent O-2 | 0.1 ml/m$^2$ |
| Gelatin | 1.5 g/m$^2$ |
| Sixth Layer: First Green-Sensitive Emulsion Layer | |
| Silver iodobromide emulsion sensitized spectrally with Sensitizing Dyes S-3 and S-4 (iodide content: 3 mol %, mean grain size: 0.3 micron) | 0.7 g/m$^2$ |
| Coupler C-2 | 0.35 g/m$^2$ |
| High Boiling Organic Solvent 0-2 | 0.07 ml/m$^2$ |
| Gelatin | 1.5 g/m$^2$ |
| Seventh Layer: Second Green-Sensitive Emulsion Layer | |
| Silver iodobromide emulsion sensitized spectrally with Sensitizing Dyes S-3 and S-4 (iodide content: 2.5 mol %, mean grain size: 0.8 micron) | 0.7 g/m$^2$ |
| Coupler C-2 | 0.25 g/m$^2$ |
| High Boiling Organic Solvent O-2 | 0.05 ml/m$^2$ |
| Gelatin | 1.3 g/m$^2$ |
| Eighth Layer: Interlayer | |
| Compound H-1 | 0.05 g/m$^2$ |
| High Boiling Organic Solvent O-2 | 0.1 ml/m$^2$ |
| Gelatin | 0.6 g/m$^2$ |
| Ninth Layer: Yellow Filter Layer | |
| Yellow colloidal silver | 0.1 g/m$^2$ |
| Compound H-1 | 0.02 g/m$^2$ |
| Compound H-2 | 0.03 g/m$^2$ |
| High Boiling Organic Solvent O-2 | 0.04 ml/m$^2$ |
| Gelatin | 1.0 g/m$^2$ |
| Tenth Layer: First Blue-Sensitive Emulsion Layer | |
| Tabular silver iodobromide emulsion sensitized spectrally with Sensitizing Dye S-5 (iodide content: 2.5 mol %, mean diameter: 0.9 micron, mean aspect ratio: 3.0) | 0.6 g/m$^2$ |
| Coupler II-1 (exemplified) | 0.5 g/m$^2$ |
| Gelatin | 1.2 g/m$^2$ |
| Eleventh Layer: | |

-continued

| | |
|---|---|
| Second Blue-Sensitive Emulsion Layer | |
| Tabular silver iodobromide emulsion sensitized spectrally with Sensitizing Dyes S-6 and S-7 (iodide content: 2.5 mol %, mean diameter: 1.5 microns, mean aspect ratio: 3.0) | 0.8 g/m$^2$ |
| Coupler I-2 (exemplified) | 1.0 g/m$^2$ |
| Gelatin | 2.5 g/m$^2$ |
| Twelfth Layer: First Protective Layer | |
| Ultraviolet Absorbent U-1 | 0.02 g/m$^2$ |
| Ultraviolet Absorbent U-2 | 0.03 g/m$^2$ |
| Ultraviolet Absorbent U-3 | 0.03 g/m$^2$ |
| Ultraviolet Absorbent U-4 | 0.29 g/m$^2$ |
| High Boiling Organic Solvent O-1 | 0.28 ml/m$^2$ |
| Gelatin | 1.6 g/m$^2$ |
| Thirteenth Layer: Second Protective Layer | |
| Surface-fogged fine grain silver iodobromide emulsion (iodide content: 1 mol %, mean grain size: 0.06 micron) | 0.1 g/m$^2$ |
| Polymethyl methacrylate particles (mean particle size: 1.5 micron) | 0.2 g/m$^2$ |
| Gelatin | 2 g/m$^2$ |

To each layer were added Gelatin Hardener H-3 and a surface active agent in addition to the above-described ingredients.

Compounds used for preparing this sample are illustrated below.

C-1

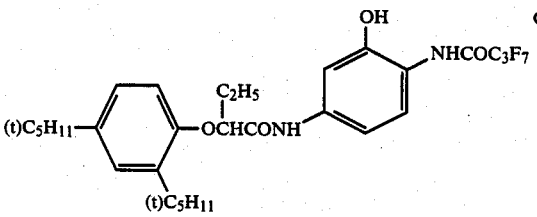

C-2

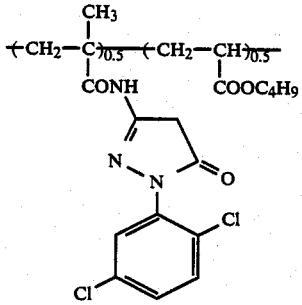

U-1

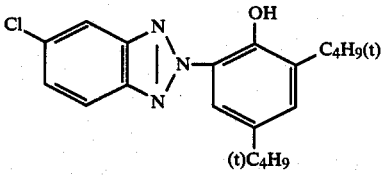

U-2

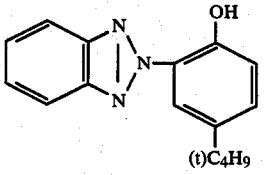

U-3

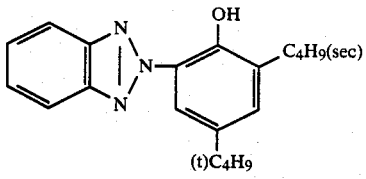

U-4

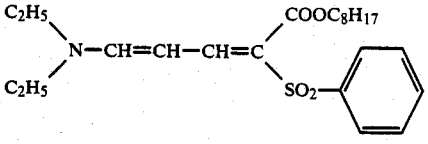

H-1

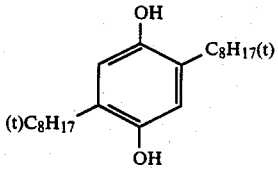

H-2

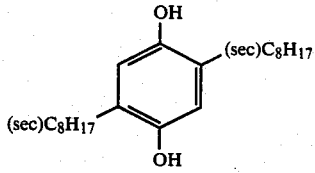

H-3

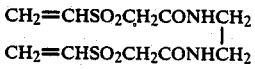

O-1

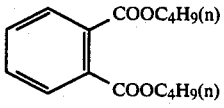

O-2

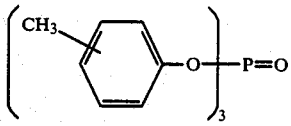

S-1

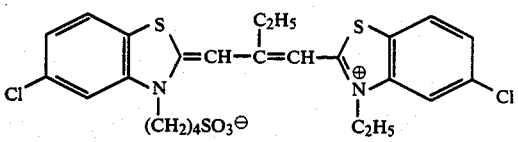

S-2

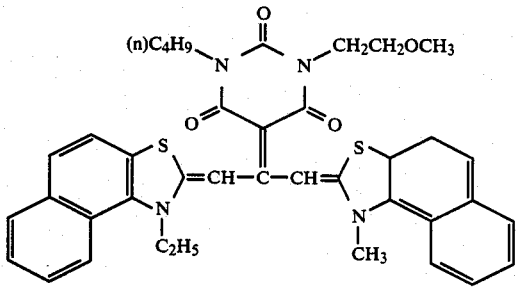

S-3

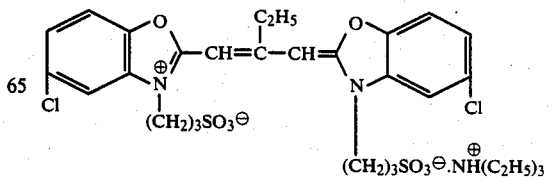

-continued

S-4

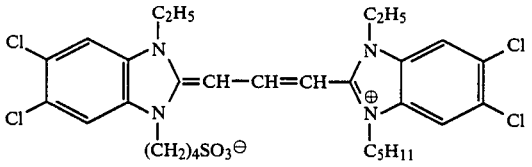

S-5

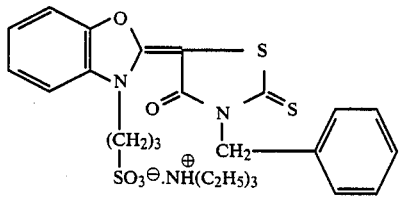

S-6

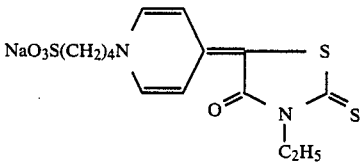

S-7

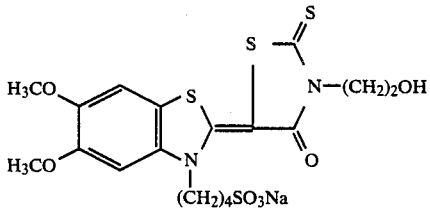

S-8

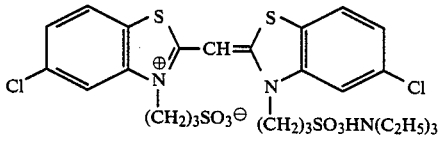

Other photographic materials (designated Samples 202 to 212) were prepared in the same manner as Sample 201 except that the coupler in the tenth layer (Coupler II-1) and the coupler in the eleventh layer (Coupler I-2) were replaced by the respective couplers set forth in Table 3, a coverage of each coupler was controlled so that $D_{max}$ of the yellow dye image formed by the reversal processing described below might become 3.5, and the aspect ratio of the tabular grain in the blue-sensitive emulsion layer was changed to 6 to 10.

Further, a photographic material (Sample 213) was prepared in the same manner as Sample 201 except that the sensitizing dye in the tenth layer was changed from S-5 to S-8, and subjected to the same reversal processing.

Each sample was examined for MTF values of cyan and magenta color images, RMS value of the yellow color image, and light fastness of the yellow color image. The results obtained are shown in Table 3.

MTF Value

The photographic materials were exposed to white light as they were brought into contact with a rectangular wave chart, and the developed materials were compared with respect to MTF values of cyan and magenta color images at the spacial frequency of 30 lines/mm. A greater MTF value means that the color image has better sharpness.

RMS Value

Each photographic material was exposed to white light through a step wedge, and the graininess of the yellow color image developed was measured with blue light according to a usual RMS (Root Mean Square) method. The aperture used for measurement was 48 microns, and the value of RMS at the density of 1.0 was employed for comparison. A smaller RMS value means that the yellow color image has better graininess.

Light Fastness

This was determined using the same method as in Example 1.

TABLE 3

| Sample No. | 10th Layer Coupler | 11th Layer Coupler | Emulsion for Blue-Sensitive Layer Mean Aspect Ratio of Tabular Emulsion |
|---|---|---|---|
| 201 (Invention) | Coupler II-1 | Coupler I-2 | 3 |
| 202 (Invention) | Coupler II-1 | Coupler I-14 | 3 |
| 203 (Invention) | Coupler II-1 | Coupler 1-2 | 6 |
| 204 (Invention) | Coupler II-13 | Coupler I-15 | 6 |
| 205 (Invention) | Coupler II-22 | Coupler I-25 | 6 |
| 206 (Comparison) | Coupler I-2 | Coupler II-1 | 6 |
| 207 (Comparison) | Coupler 1-15 | Coupler II-13 | 6 |
| 208 (Comparison) | Coupler I-2 | Coupler I-2 | 6 |
| 209 (Comparison) | Coupler II-1 | Coupler II-1 | 6 |
| 210 (Comparison) | Coupler A | Coupler B | 6 |
| 211 (Invention) | Coupler II-1 | Coupler 1-2 | 10 |
| 212 (Invention) | Coupler II-1 | Coupler I-14 | 10 |
| 213 (Invention) | Coupler 11-1 | Coupler I-2 | 6 |

| Processing Steps: | | |
|---|---|---|
| Step | Time (min) | Temperature (°C.) |
| First Development | 6 | 38 |
| Washing | 2 | " |
| Reversing | 2 | " |
| Color Development | 6 | " |
| Adjustment | 2 | " |
| Bleaching | 6 | " |
| Fixation | 4 | " |
| Washing | 4 | " |
| Stabilization | 1 | Room Temperature |

The processing solutions used had the following positions.

| | |
|---|---|
| First Developing Solution: | |
| Water | 700 ml |
| Pentasodium Nitrilo-N,N,N—trimethylene-phosphonate | 2 g |
| Sodium Sulfite | 20 g |
| Hydroquinone Monosulfonate | 30 g |
| Sodium Carbonate (monohydrate) | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% solution) | 2 ml |
| Water to make | 1,000 ml |
| Reversing Solution: | |
| Water | 700 ml |
| Pentasodium Nitrilo-N,N,N—trimethylene-phosphonate | 3 g |
| Stannous Chloride (dihydrate) | 1 g |
| p-Aminophenol | 0.1 g |

-continued

| | |
|---|---|
| Sodium Hydroxide | 8 g |
| Glacial Acetic Acid | 15 ml |
| Water to make | 1,000 ml |
| Color Developing Solution: | |
| Water | 700 ml |
| Pentasodium Nitrilo-N,N,N—trimethylene-phosphonate | 3 g |
| Sodium Sulfite | 7 g |
| Sodium Tertiary Phosphate (dodecahydrate) | 36 g |
| Potassium Bromide | 1 g |
| Potassium Iodide (0.1% solution) | 90 ml |
| Sodium Hydroxide | 3 g |
| Citrazinic Acid | 1.5 g |
| N—Ethyl-N—(β-methanesulfonamidoethyl)-3-methyl-4-aminoaniline Sulfate | 11 g |
| 3,6-Dithiaoctane-1,8-diol | 1 g |
| Water to make | 1,000 ml |
| Adjusting Solution: | |
| Water | 700 ml |
| Sodium Sulfite | 12 g |
| Sodium Ethylenediaminetetraacetate (dihydrate) | 8 g |
| Thioglycerine | 0.4 g |
| Glacial Acetic Acid | 3 ml |
| Water to make | 1,000 ml |
| Bleaching Solution: | |
| Water | 800 ml |
| Sodium Ethylenediaminetetraacetate (dihydrate) | 2 g |
| Ammonium Ethylenediaminetetraacetato-ferrate(III) (dihydrate) | 120 g |
| Potassium Bromide | 100 g |
| Water to make | 1,000 ml |
| Fixing Solution: | |
| Water | 800 ml |
| Sodium Thiosulfate | 80.0 g |
| Sodium Sulfite | 5.0 g |
| Sodium Bisulfite | 5.0 g |
| Water to make | 1,000 ml |
| Stabilizing Solution: | |
| Water | 800 ml |
| Formaldehyde (37 wt % aq. soln.) | 5.0 ml |
| Fuji Driwel (surface active agent produced by Fuji Photo Film Co., Ltd.) | 5.0 ml |
| Water to make | 1,000 ml |

TABLE 4

| | MTF Value (30 lines/mm) | | RMS Value | Light Fastness |
|---|---|---|---|---|
| Sample No. | Cyan Color Image | Magenta Color Image | Yellow Color Image | Yellow Color Image (%) |
| 201 (Invention) | 0.60 | 0.73 | 0.021 | 91 |
| 202 (Invention) | 0.60 | 0.72 | 0.020 | 90 |
| 203 (Invention) | 0.64 | 0.78 | 0.022 | 91 |
| 204 (Invention) | 0.63 | 0.76 | 0.022 | 90 |
| 205 (Invention) | 0.64 | 0.77 | 0.021 | 93 |
| 206 (Comparison) | 0.52 | 0.69 | 0.030 | 90 |
| 207 (Comparison) | 0.51 | 0.67 | 0.031 | 89 |
| 208 (Comparison) | 0.62 | 0.76 | 0.033 | 83 |
| 209 (Comparison) | 0.52 | 0.69 | 0.022 | 90 |
| 210 (Comparison) | 0.46 | 0.58 | 0.024 | 43 |
| 211 (Invention) | 0.64 | 0.78 | 0.023 | 91 |
| 212 (Invention) | 0.64 | 0.77 | 0.022 | 90 |
| 213 (Invention) | 0.62 | 0.75 | 0.024 | 91 |

As can be seen from the results shown in Table 4, samples 203 to 205 prepared in aocordance with the present invention gave great satisfaction in sharpness of cyan and magenta color images, graininess of yellow color image and light fastness of yellow color image, compared with Samples 206 and 210 prepared for comparison. Of the samples of the present invention, those which contained tabular emulsions having an aspect ratio of 5 or more in the blue-sensitive layers demonstrated further improved sharpness, although the present invention was not particularly restricted as to the kind of emulsion to be used in the blue-sensitive layers. Accordingly, using a tabular emulsion has proved to be a more preferred embodiment in the present invention.

EXAMPLE 3

On a cellulose triacetate film support having a subbing layer were coated layers having the following compositions to prepare a multilayer color photographic material (which was designated Sample 301). A coating amount of an emulsion is indicated using an amount of silver coated.

| | |
|---|---|
| First Layer: Antihalation Layer | |
| Black colloidal silver | 0.25 g/m$^2$ |
| Ultraviolet Absorbent U-1 | 0.04 g/m$^2$ |
| Ultraviolet Absorbent U-2 | 0.1 g/m$^2$ |
| Ultraviolet Absorbent U-3 | 0.1 g/m$^2$ |
| High Boiling Organic Solvent O-1 | 0.1 ml/m$^2$ |
| Gelatin | 2.5 g/m$^2$ |
| Second Layer: Interlayer | |
| Compound H-1 | 0.05 g/m$^2$ |
| High Boiling Organic Solvent O-2 | 0.05 ml/m$^2$ |
| Gelatin | 0.6 g/m$^2$ |
| Third Layer: First Red-Sensitive Emulsion Layer | |
| Silver iodobromide emulsion sensitized spectrally with Sensitizing Dyes S-1 and S-2 (iodide content: 4 mol %, mean grain size: 0.3 micron) | 0.5 g/m$^2$ |
| Coupler C-1 | 0.25 g/m$^2$ |
| High Boiling Organic Solvent O-2 | 0.12 ml/m$^2$ |
| Gelatin | 1.1 g/m$^2$ |
| Fourth Layer: Second Red-Sensitive Emulsion Layer | |
| Silver iodobromide emulsion sensitized spectrally with Sensitizing Dyes S-1 and S-2 (iodide content: 2.5 mol %, mean grain size: 0.55 micron) | 0.8 g/m$^2$ |
| Coupler C-1 | 0.73 g/m$^2$ |
| High Boiling Organic Solvent O-2 | 0.37 ml/m$^2$ |
| Gelatin | 1.8 g/m$^2$ |
| Fifth Layer: Interlayer | |
| Compound H-1 | 0.1 g/m$^2$ |
| High Boiling Organic Solvent O-2 | 0.1 ml/m$^2$ |
| Gelatin | 1.5 g/m$^2$ |
| Sixth Layer: First Green-Sensitive Emulsion Layer | |
| Silver iodobromide emulsion sensitized spectrally with Sensitizing Dyes S-3 and S-4 (iodide content: 3 mol %, mean grain size: 0.3 micron) | 0.7 g/m$^2$ |
| Coupler C-2 | 0.35 g/m$^2$ |
| High Boiling Organic Solvent 0-2 | 0.07 ml/m$^2$ |
| Gelatin | 1.5 g/m$^2$ |
| Seventh Layer: Second Green-Sensitive Emulsion Layer | |
| Silver iodobromide emulsion sensitized spectrally with Sensitizing Dyes S-3 and S-4 (iodide content: 2.5 mol %, mean grain size: 0.8 micron) | 0.7 g/m$^2$ |
| Coupler C-2 | 0.25 g/m$^2$ |
| High Boiling Organic Solvent O-2 | 0.05 ml/m$^2$ |
| Gelatin | 1.3 g/m$^2$ |
| Eighth Layer: Interlayer | |
| Compound H-1 | 0.05 g/m$^2$ |
| High Boiling Organic Solvent O-2 | 0.1 ml/m$^2$ |
| Gelatin | 0.6 g/m$^2$ |
| Ninth Layer: Yellow Filter Layer | |
| Yellow colloidal silver | 0.1 g/m$^2$ |
| Compound H-1 | 0.02 g/m$^2$ |
| Compound H-2 | 0.03 g/m$^2$ |
| High Boiling Organic Solvent O-2 | 0.04 ml/m$^2$ |
| Gelatin | 1.0 g/m$^2$ |
| Tenth Layer: First Blue-Sensitive Emulsion Layer | |
| Tabular silver iodobromide emulsion sensitized spectrally with Sensitizing Dye S-5 (iodide content: 2.5 mol %, mean | 0.6 g/m$^2$ |

-continued

| | |
|---|---|
| diameter: 0.5 micron, mean aspect ratio: 8.0) | |
| Coupler II-1 (exemplified) | 0.5 g/m$^2$ |
| Gelatin | 1.2 g/m$^2$ |
| Eleventh Layer: | |
| Second Blue-Sensitive Emulsion Layer | |
| Tabular silver iodobromide emulsion sensitized spectrally with Sensitizing Dyes S-5 (iodide content: 2.5 mol %, mean diameter: 0.8 micron, mean aspect ratio: 8.0) | 0.4 g/m$^2$ |
| Coupler II-1 (exemplified) | 0.7 g/m$^2$ |
| Gelatin | 1.8 g/m$^2$ |
| Twelfth Layer: Third Blue-Sensitive Layer | |
| Tabular silver iodobromide emulsion sensitized spectrally with Sensitizing Dye S-5 (iodide content: 2.5 mol %, mean diameter: 1.3 microns, mean aspect ratio: 8.0) | 0.4 g/m$^2$ |
| Coupler I-2 (exemplified) | 1.0 g/m$^2$ |
| Gelatin | 2.5 g/m$^2$ |
| Thirteenth Layer: First Protective Layer | |
| Ultraviolet Absorbent U-1 | 0.02 g/m$^2$ |
| Ultraviolet Absorbent U-2 | 0.03 g/m$^2$ |
| Ultraviolet Absorbent U-3 | 0.03 g/m$^2$ |
| Ultraviolet Absorbent U-4 | 0.29 g/m$^2$ |
| High Boiling Organic Solvent O-1 | 0.28 ml/m$^2$ |
| Gelatin | 1.6 g/m$^2$ |
| Fourteenth Layer: Second Protective Layer | |
| Surface-fogged fine grain silver iodobromide emulsion (iodide content: 1 mol %, mean grain size: 0.06 micron) | 0.1 g/m$^2$ |
| Polymethyl methacrylate particles (mean particle size: 1.5 micron) | 0.2 g/m$^2$ |
| Gelatin | 2 g/m$^2$ |

To each layer were added Gelatin Hardener H-3 and a surface active agent in addition to the above-described ingredients.

The compounds used for preparing the samples in this example (e.g., Ultraviolet Absorbent U-1, High Boiling Organic Solvent O-1, etc.) were the same as those used in Example 2.

Then, other photographic materials (designated Samples 302 to 332) were prepared in the same manner as Sample 301 except that the coupler (Coupler II-1) and the sensitizing dye (S-5) in the tenth layer, the coupler (Coupler II-1) and the sensitizing dye (S-5) in the eleventh layer, and the coupler (Coupler I-2) and the sensitizing dye (S-5) in the twelfth layer were replaced by the respective couplers and sensitizing dyes set forth in Table 5, and a coverage of each coupler was controlled so that $D_{max}$ of the yellow color image developed through the same reversal processing as described in Example 2 might become 3.5.

Each sample thus obtained ws examined for MTF values of the cyan and magenta color images, respectively, and RMS value of the yellow color image using the same methods as in Example 2. The results obtained are shown in Table 6.

Sentiziing dyes used additionally in Example 3 are illustrated below.

(exemplified Sensitizing Dye IX-11)

-continued

S-9

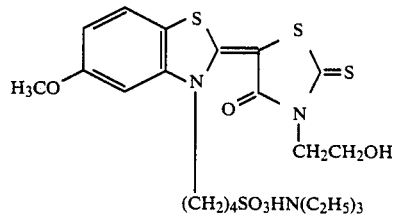

(exemplified Sensitizing Dye X-1)

S-10

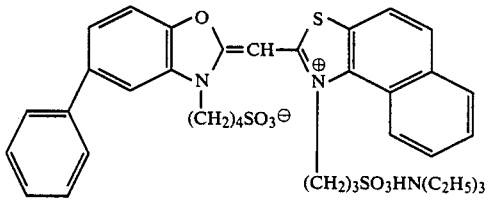

(exemplified Sensitizing Dye X-5)

S-11

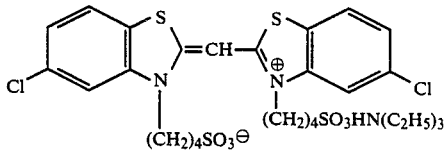

(exemplified Sensitizing Dye X-6)

S-12

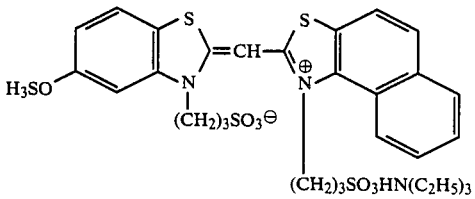

C-3

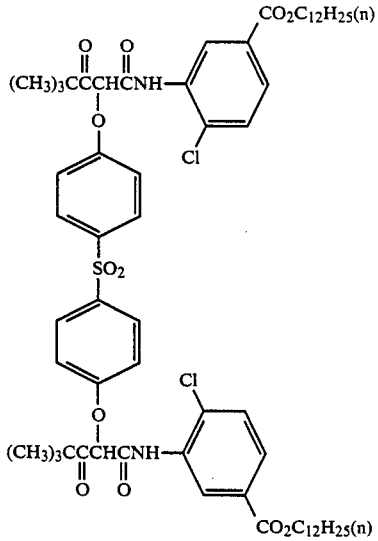

TABLE 5

| Sample No. | 10th Layer Coupler | 10th Layer Sensitizing Dye | 11th Layer Coupler | 11th Layer Sensitizing Dye | 12th Layer Coupler | 12th Layer Sensitizing Dye |
|---|---|---|---|---|---|---|
| 301 (Invention) | II-1 | S-5 | II-1 | S-5 | I-2 | S-5 |
| 302 (Invention) | " | S-6 | " | S-6 | " | S-6 |

TABLE 5-continued

| Sample No. | 10th Layer Coupler | 10th Layer Sensitizing Dye | 11th Layer Coupler | 11th Layer Sensitizing Dye | 12th Layer Coupler | 12th Layer Sensitizing Dye |
|---|---|---|---|---|---|---|
| 303 (Invention) | " | S-9 | " | S-9 | " | S-9 |
| 304 (Invention) | " | S-10 | " | S-10 | " | S-10 |
| 305 (Invention) | " | S-11 | " | S-11 | " | S-11 |
| 306 (Invention) | " | S-12 | " | S-12 | " | S-12 |
| 307 (Invention) | " | S-5 | " | S-5<br>S-9 | " | S-5<br>S-6 |
| 308 (Invention) | " | S-10 | " | S-10 | " | S-11 |
| 309 (Invention) | " | S-10 | " | S-10 | " | S-12 |
| 310 (Invention) | " | S-10 | " | S-10 | " | S-6 |
| 311 (Invention) | " | S-11 | " | S-11 | " | S-12 |
| 312 (Invention) | " | S-11 | " | S-11 | " | S-5 |
| 313 (Invention) | " | S-10 | " | S-10 | " | S-10<br>S-11 |
| 314 (Invention) | " | S-11 | " | S-11 | " | S-11<br>S-5 |
| 315 (Invention) | II-1 | S-10 | II-1 | S-11<br>S-10 | I-2 | S-12<br>S-10 |
| 316 (Invention) | " | S-10<br>S-5 | " | S-11<br>S-10 | " | S-12<br>S-10<br>S-11 |
| 317 (Invention) | " | S-5 | " | S-9<br>S-11 | " | S-12<br>S-10 |
| 318 (Invention) | " | S-5<br>S-10 | " | S-11<br>S-9 | " | S-12<br>S-6 |
| 319 (Invention) | " | S-5<br>S-10 | " | S-5<br>S-11 | " | S-5<br>S-11<br>S-12 |
| 320 (Invention) | " | S-5 | " | S-10<br>S-11 | " | S-10<br>S-11<br>S-12 |
| 321 (Invention) | " | S-10 | II-1<br>I-2 | S-11<br>S-10 | I-2<br>I-1 | S-12<br>S-10 |
| 322 (Invention) | " | " | I-1 | " | I-14 | " |
| 323 (Invention) | " | " | " | " | I-15 | " |
| 324 (Invention) | " | " | 11-1 | " | I-2<br>C-3 | " |
| 325 (Comparison) | I-2 | S-6 | I-2 | S-6 | II-1 | S-6 |
| 326 (Comparison) | " | " | II-1 | " | " | " |
| 327 (Comparison) | " | S-5 | " | S-5<br>S-9 | " | S-5<br>S-6 |
| 328 (Comparison) | " | S-10 | " | S-10 | " | S-11 |
| 329 (Comparison) | II-1 | S-10 | II-1 | S-10 | II-1 | S-11 |
| 330 (Comparison) | I-2 | " | I-2 | " | I-2 | " |
| 331 (Comparsion) | I-15 | " | I-1 | " | II-1 | " |
| 332 (Comparsion) | " | S-5 | " | S-11<br>S-10 | " | S-12<br>S-11<br>S-10 |

TABLE 6

| Sample No. | MTF Value (30 lines/mm) Cyan Image | MTF Value (30 lines/mm) Magenta Image | RMS Value Yellow Image |
|---|---|---|---|
| 301 (Invention) | 0.64 | 0.74 | 0.022 |
| 302 (Invention) | 0.60 | 0.73 | 0.020 |
| 303 (Invention) | 0.63 | 0.72 | 0.021 |
| 304 (Invention) | 0.62 | 0.74 | 0.022 |
| 305 (Invention) | 0.64 | 0.72 | 0.021 |
| 306 (Invention) | 0.63 | 0.73 | 0.019 |

TABLE 6-continued

| Sample No. | MTF Value (30 lines/mm) Cyan Image | MTF Value (30 lines/mm) Magenta Image | RMS Value Yellow Image |
|---|---|---|---|
| 307 (Invention) | 0.62 | 0.72 | 0.020 |
| 308 (Invention) | 0.63 | 0.77 | 0.021 |
| 309 (Invention) | 0.62 | 0.72 | 0.020 |
| 310 (Invention) | 0.63 | 0.71 | 0.020 |
| 311 (Invention) | 0.64 | 0.73 | 0.020 |
| 312 (Invention) | 0.63 | 0.78 | 0.022 |
| 313 (Invention) | 0.64 | 0.77 | 0.021 |
| 314 (Invention) | 0.65 | 0.76 | 0.021 |
| 315 (Invention) | 0.63 | 0.77 | 0.020 |
| 316 (Invention) | 0.64 | 0.78 | 0.019 |
| 317 (Invention) | 0.65 | 0.77 | 0.020 |
| 318 (Invention) | 0.64 | 0.78 | 0.020 |
| 319 (Invention) | 0.63 | 0.76 | 0.020 |
| 320 (Invention) | 0.65 | 0.77 | 0.020 |
| 321 (Invention) | 0.64 | 0.76 | 0.020 |
| 322 (Invention) | 0.65 | 0.76 | 0.022 |
| 323 (Invention) | 0.63 | 0.72 | 0.022 |
| 324 (Invention) | 0.62 | 0.74 | 0.020 |
| 325 (Comparison) | 0.52 | 0.69 | 0.030 |
| 326 (Comparison) | 0.53 | 0.68 | 0.027 |
| 327 (Comparison) | 0.54 | 0.69 | 0.028 |
| 328 (Comparison) | 0.52 | 0.67 | 0.028 |
| 329 (Comparison) | 0.52 | 0.69 | 0.022 |
| 330 (Comparison) | 0.62 | 0.76 | 0.033 |
| 331 (Comparison) | 0.51 | 0.67 | 0.031 |
| 332 (Comparison) | 0.53 | 0.66 | 0.034 |

As can be seen from the results shown in Table 6, Samples 301 to 324 prepared in accordance with the present invention were excellent in the sharpness of the cyan and the magenta color images, and the graininess of the yellow color image, irrespective of the kind of sensitizing dye used in combination, a merocyanine dye, a cyanine dye or a mixture thereof, compared with Samples 325 to 332 prepared for comparison.

From a comparison of the results of Sample 302 with those of Samples 325 and 326, from a comparison of the results of Sample 307 with those of Sample 327, from a comparison of the results of Sample 308 with those of Samples 328 to 331, and from a comparison of the results of Sample 320 with those of Sample 332, superiority of the embodiments of the present invention is apparent.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material prising a support having provided thereon at least a blue-sensitive emulsion layer, a green-sensitive emulsion layer and a red-sensitive emulsion layer, said blue-sensitive emulsion layer comprising at least two layers differing in sensitivity, one of which is the highest sensitive blue-sensitive emulsion layer containing at least one yellow-dye-forming coupler represented by the general formula (I), and the other of which is the lowest sensitive blue-sensitive emulsion layer containing at least one yellow-dye-forming coupler represented by the general formula (V):

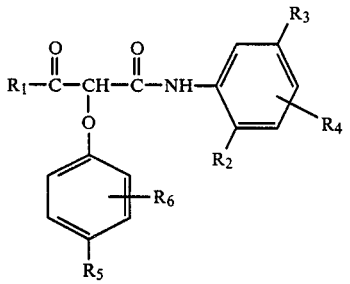

(I)

wherein $R_1$ represents a tertiary alkyl group; $R_2$ represents a halogen atom, an alkoxy group, or a hydrogen atom; $R_3$ represents an alkoxycarbonyl group, an aryloxycarbonyl group, an alkylsulfonamido group, an arylsulfonamido group, or an acylamino group; $R_4$ represents a hydrogen atom, a halogen atom, an alkoxy group, an alkyl group, or an acylamino group; $R_5$ represents an arylsulfonyl group, an alkylsulfonyl group, an alkoxycarbonyl group, an aryloxycarbonyl group, a cyano group, an acyl group, an acylamino group, an alkylsulfamoyl group, an arylsulfamoyl group, an alkylsulfonamido group, an arylsulfonamido group, an alkoxysulfonyl group, an aryloxysulfonyl group, an alkylcarbamoyl group, an arylcarbamoyl group, a carboxyl group, or a nitro group; and $R_6$ represents a hydrogen atom, a halogen atom, an alkyl group, an alkoxy group, a hydroxy group, an acylamino group, an alkylsulfonamino group, an arylsulfonamino group, a carboxyl group, or an alkoxycarbonyl group;

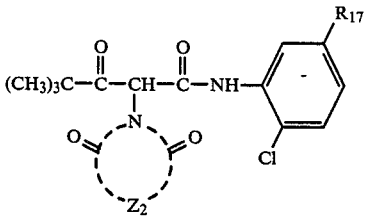

(V)

wherein $R_{17}$ represents an unsubstituted or substituted alkoxycarbonyl group or an unsubstituted alkylsulfonamido group; and $Z_2$ represents atoms necessary to form a 5- or 6-membered ring.

2. A silver halide color photographic material as claimed in claim 1, wherein the yellow-dye-forming coupler represented by the general formula (I) is one member selected from the group consisting of the couplers represented by the following general formula (III) or (IV):

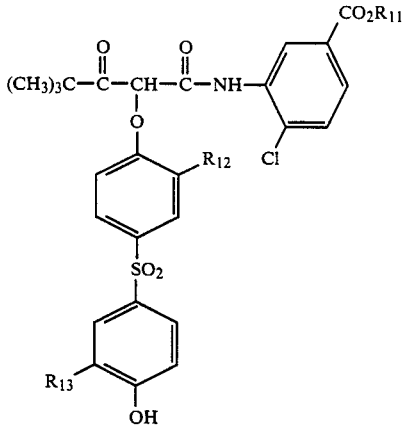

(III)

wherein $R_{11}$ represents an unsubstituted or substituted alkyl group containing 8 to 20 carbon atoms; and $R_{12}$ and $R_{13}$, which may be the same or different, each represents a hydrogen atom, a halogen atom, an acylamino group, or a sulfonamido group;

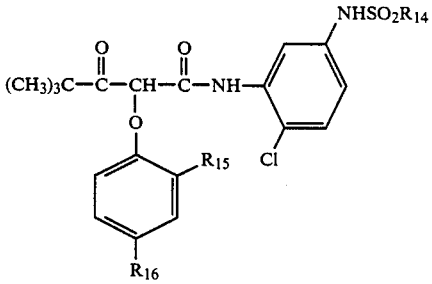

(IV)

wherein $R_{14}$ represents an unsubstituted or substituted alkyl group containing 8 to 20 carbon atoms or a phenyl group having at least one alkoxy group or having at least one alkyl group; $R_{15}$ represents a hydrogen atom, a halogen atom, an acylamino group, or an alkylsulfonamido group; and $R_{16}$ represents an alkoxycarbonyl group, a sulfonamido group, a cyano group, an acyl group, a sulfonyl group, an acylamino group, or a carbamoyl group.

3. A silver halide color photographic material as claimed in claim 2, wherein $R_{11}$ represents a straight or branched chain, unsubstituted alkyl group having 10 to 18 carbon atoms, and $R_{12}$ and $R_{13}$ each represents a hydrogen atom or a halogen atom.

4. A silver halide color photographic material as claimed in claim 7, wherein $R_{17}$ represents a straight or branched chain, unsubstituted alkoxycarbonyl group having 10 to 18 carbon atoms or a straight or branched chain, unsubstituted alkylsulfonamido group having 8 to 20 carbon atoms, and $Z_2$ represents non-metallic atoms necessary to form a hydantoin nucleus.

5. A silver halide color photographic material as claimed in claim 1, wherein said yellow-dye-forming couplers represented by the general formula (I) or (V) are dispersed using high boiling organic solvents represented by the following general formula (VI) or (VII):

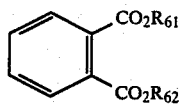

(VI)

wherein $R_{61}$ and $R_{62}$ may be the same or different, and each represents an alkyl group, a cycloalkyl group, an alkenyl group or an aryl group, provided that the substituent groups represented by $R_{61}$ and $R_{62}$ each contains 4 to 30 carbon atoms;

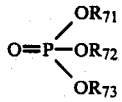

(VII)

wherein $R_{71}$, $R_{72}$ and $R_{73}$ may be the same or different, and each represents an alkyl group, a cycloalkyl group, an alkenyl group, or an aryl group, provided that the total number of carbon atoms contained in the substituent groups represented by $R_{71}$, $R_{72}$ or $R_{73}$ is 12 to 60.

6. A silver halide color photographic material as claimed in claim 1, wherein the blue-sensitive emulsion layer in said silver halide color photographic material contains a sensitizing dye represented by the following general formula (VIII-1), (VIII-2), (IX) or (X):

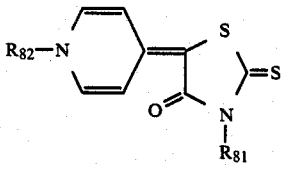

(VIII-1)

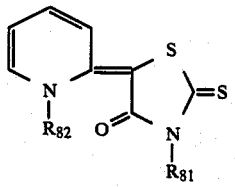

(VIII-2)

wherein $R_{81}$ represents an unsubstituted or substituted alkyl group, an unsubstituted or substituted aryl group, an aralkyl group, an alkenyl group, or an allyl group; and $R_{82}$ represents an unsubstituted or substituted alkyl group, an alkenyl group, or an allyl group;

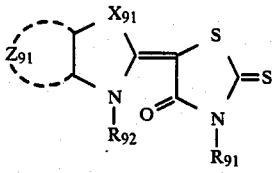

(IX)

wherein $R_{91}$ represents an unsubstituted or substituted alkyl group, an unsubstituted or substituted aryl group, an aralkyl group, an alkenyl group, or an allyl group; $R_{92}$ represents an unsubstituted or substituted alkyl group, an alkenyl group or an allyl group; $X_{91}$ represents an oxygen atom or a sulfur atom; and $Z_{91}$ represents atoms necessary to complete a benzene ring or a naphthalene ring;

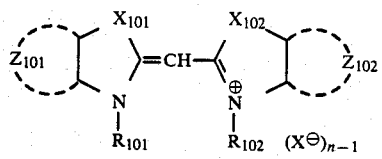

(X)

wherein $X_{101}$ and $X_{102}$ each represents an oxygen atom or a sulfur atom; $R_{101}$ and $R_{102}$ each represents an unsubstituted or substituted alkyl group, an alkenyl group, or an allyl group; $Z_{101}$ and $Z_{102}$ each represents atoms necessary to complete a benzene ring or a naphthalene ring; $X^{\ominus}$ represents an acid anion; and n represents 1 or 2.

7. A silver halide color photographic material as claimed in claim 2, wherein said yellow-dye-forming couplers represented by the general formula (III) or (IV) are dispersed using high boiling organic solvents represented by the following general formula (VI) or (VII):

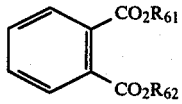

(VI)

wherein $R_{61}$ and $R_{62}$ may be the same or different, and each represents an alkyl group, a cycloalkyl group, an alkenyl group or an aryl group, provided that the substituent groups represented by $R_{61}$ and $R_{62}$ each contains 4 to 30 carbon atoms;

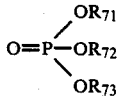

(VII)

wherein $R_{71}$, $R_{72}$ and $R_{73}$ may be the same or different, and each represents an alkyl group, a cycloalkyl group, an alkenyl group, or an aryl group, provided that the total number of carbon atoms contained in the substituent groups represented by $R_{71}$, $R_{72}$ or $R_{73}$ is 12 to 60.

8. A silver halide color photographic material as claimed in claim 3, wherein said yellow-dye-forming couplers represented by the general formula (III) are dispersed using high boiling organic solvents represented by the following general formula (VI) or (VII):

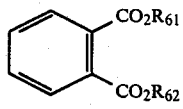

(VI)

wherein $R_{61}$ and $R_{62}$ may be the same or different, and each represents an alkyl group, a cycloalkyl group, an alkenyl group or an aryl group, provided that the substituent groups represented by $R_{61}$ and $R_{62}$ each contains 4 to 30 carbon atoms;

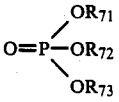

(VII)

wherein $R_{71}$, $R_{72}$ and $R_{73}$ may be the same or different, and each represents an alkyl group, a cycloalkyl group, an alkenyl group, or an aryl group, provided that the total number of carbon atoms contained in the substituent groups represented by $R_{71}$, $R_{72}$ or $R_{73}$ is 12 to 60.

9. A silver halide color photographic material as claimed in claim 1, wherein said yellow-dye-forming couplers represented by the general formula (V) are dispersed using high boiling organic solvents represented by the following general formula (VI) or (VII):

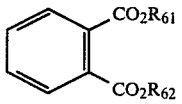

(VI)

wherein $R_{61}$ and $R_{62}$ may be the same or different, and each represents an alkyl group, a cycloalkyl group, an alkenyl group or an aryl group, provided that the substituent groups represented by $R_{61}$ and $R_{62}$ each contains 4 to 30 carbon atoms;

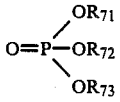

(VII)

$R_{71}$, $R_{72}$ and $R_{73}$ may be the same or different, and each represents an alkyl group, a cycloalkyl group, an alkenyl group, or an aryl group, provided that the total number of carbon atoms contained in the substituent groups represented by $R_{71}$, $R_{72}$ or $R_{73}$ is 12 to 60.

10. A silver halide color photographic material as claimed in claim 4, wherein said yellow-dye-forming couplers represented by the general formula (V) are dispersed using high boiling organic solvents represented by the following general formula (VI) or (VII):

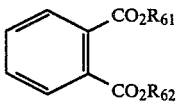

(VI)

wherein $R_{61}$ and $R_{62}$ may be the same or different, and each represents an alkyl group, a cycloalkyl group, an alkenyl group or an aryl group, provided that the substituent groups represented by $R_{61}$ and $R_{62}$ each contains 4 to 30 carbon atoms;

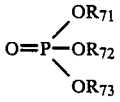

(VII)

wherein $R_{71}$, $R_{72}$ and $R_{73}$ may be the same or different, and each represents an alkyl group, a cycloalkyl group, an alkenyl group, or an aryl group, provided that the total number of carbon atoms contained in the substituent groups represented by $R_{71}$, $R_{72}$ or $R_{73}$ is 12 to 60.

11. A silver halide color photographic material as claimed in claim 2, wherein the blue-sensitive emulsion layer in said silver halide color photographic material contains a sensitizing dye represented by the following general formula (VIII-1), (VIII-2), (IX) or (X):

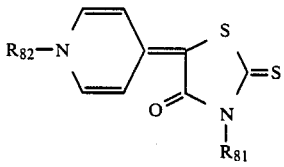

(VIII-1)

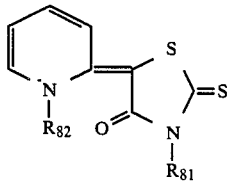

(VIII-2)

wherein $R_{81}$ represents an unsubstituted or substituted alkyl group, an unsubstituted or substituted aryl group, an aralkyl group, an alkenyl group, or an allyl group; and $R_{82}$ represents an unsubstituted or substituted alkyl group, an alkenyl group, or an allyl group;

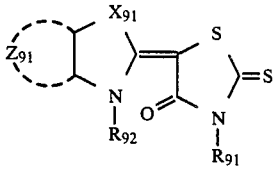

(IX)

wherein $R_{91}$ represents an unsubstituted or substituted alkyl group, an unsubstituted or substituted aryl group, an aralkyl group, an alkenyl group, or an allyl group; $R_{92}$ represents an unsubstituted or substituted alkyl group, an alkenyl group or an allyl group; $X_{91}$ represents an oxygen atom or a sulfur atom; and $Z_{91}$ represents atoms necessary to complete a benzene ring or a naphthalene ring;

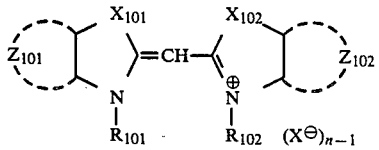

(X)

wherein $X_{101}$ and $X_{102}$ each represents an oxygen atom or a sulfur atom; $R_{101}$ and $R_{102}$ each represents an unsubstituted or substituted alkyl group, an alkenyl group or an allyl group; $Z_{101}$ and $Z_{102}$ each represents atoms necessary to complete a benzene ring or a naphthalene ring; $X^{\ominus}$ represents an acid anion; and n represents 1 or 2.

12. A silver halide color photographic material as claimed in claim 3, wherein the blue-sensitive emulsion layer in said silver halide color photographic material contains a sensitizing dye represented by the following general formula (VIII-1), (VIII-2), (IX) or (X):

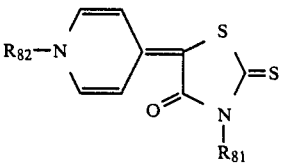

(VIII-1)

-continued (VIII-2)

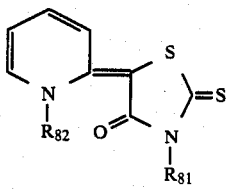

wherein $R_{81}$ represents an unsubstituted or substituted alkyl group, an unsubstituted or substituted aryl group, an aralkyl group, an alkenyl group, or an allyl group; and $R_{82}$ represents an unsubstituted or substituted alkyl group, an alkenyl group, or an allyl group;

(IX)

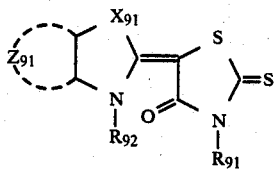

wherein $R_{91}$ represents an unsubstituted or substituted alkyl group, an unsubstituted or substituted aryl group, an aralkyl group, an alkenyl group, or an allyl group; $R_{92}$ represents an unsubstituted or substituted alkyl group, an alkenyl group or an allyl group; $X_{91}$ represents an oxygen atom or a sulfur atom; and Z91 represents atoms necessary to complete a benzene ring or a naphthalene ring;

(X)

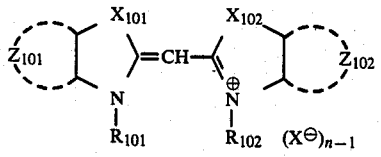

wherein $X_{101}$ and $X_{102}$ each represents an oxygen atom or a sulfur atom; $R_{101}$ and $R_{102}$ each represents an unsubstituted or substituted alkyl group, an alkenyl group or an allyl group; $Z_{101}$ and $Z_{102}$ each represents atoms necessary to complete a benzene ring or a naphthalene ring; $X^{\ominus}$ represents an acid anion; and n represents 1 or 2.

13. A silver halide color photographic material claimed in claim 4, wherein the blue-sensitive emulsion layer in said silver halide color photographic material contains a sensitizing dye represented by the following general formula (VIII-1), (VIII-2), (IX) or (X):

(VIII-1)

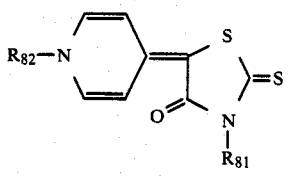

(VIII-2)

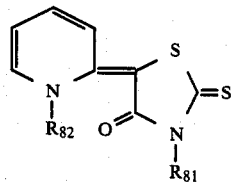

where $R_{81}$ represents an unsubstituted or substituted alkyl group, an unsubstituted or substituted aryl group, an aralkyl group, an alkenyl group or an allyl group; and $R_{82}$ represents an unsubstituted or substituted alkyl group, an alkenyl group or an allyl group;

(IX)

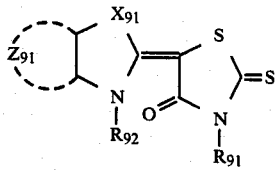

wherein $R_{91}$ represents an unsubstituted or substituted alkyl group, an unsubstituted or substituted aryl group, an aralkyl group, an alkenyl group or an allyl group; $R_{92}$ represents an unsubstituted or substituted alkyl group, an alkenyl group or an allyl group; $X_{91}$ represents an oxygen atom or a sulfur atom; and $Z_{91}$ represents atoms necessary to complete a benzene ring or a naphthalene ring;

(X)

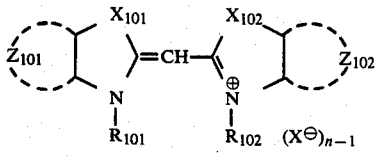

wherein $X_{101}$ and $X_{102}$ each represents an oxygen atom or a sulfur atom; $R_{101}$ and $R_{102}$ each represents an unsubstituted or substituted alkyl group, an alkenyl group or an allyl group; $Z_{101}$ and $Z_{102}$ each represents atoms necessary to complete a benzene ring or a naphthalene ring; $X^{\ominus}$ represents an acid anion; and n represents 1 or 2.

* * * * *